US012378838B2

(12) United States Patent
Chen et al.

(10) Patent No.: US 12,378,838 B2
(45) Date of Patent: Aug. 5, 2025

(54) HYDRAULIC FRACTURING VALVE SYSTEM

(71) Applicant: Schlumberger Technology Corporation, Sugar Land, TX (US)

(72) Inventors: Yang Chen, Houston, TX (US); Muktabh Anchlia, Clamart (FR); Mark Viator, Houston, TX (US)

(73) Assignee: Schlumberger Technology Corporation, Sugar Land, AS (US)

( * ) Notice: Subject to any disclaimer, the term of this patent is extended or adjusted under 35 U.S.C. 154(b) by 158 days.

(21) Appl. No.: 18/339,375

(22) Filed: Jun. 22, 2023

(65) Prior Publication Data

US 2023/0417118 A1 Dec. 28, 2023

Related U.S. Application Data

(60) Provisional application No. 63/354,661, filed on Jun. 22, 2022.

(51) Int. Cl.

| | |
|---|---|
| ***E21B 33/068*** | (2006.01) |
| ***E21B 34/16*** | (2006.01) |
| *E21B 34/02* | (2006.01) |

(52) U.S. Cl.
CPC ..... *E21B 33/068* (2013.01); *E21B 34/16* (2013.01); *E21B 34/02* (2013.01)

(58) Field of Classification Search
CPC ..... E21B 34/16; E21B 33/068
See application file for complete search history.

(56) References Cited

U.S. PATENT DOCUMENTS

| | | | | |
|---|---|---|---|---|
| 2014/0352968 | A1* | 12/2014 | Pitcher | E21B 43/2607 166/308.1 |
| 2015/0345272 | A1* | 12/2015 | Kajaria | E21B 47/00 166/308.1 |
| 2019/0120024 | A1* | 4/2019 | Oehring | E21B 43/26 |
| 2021/0087925 | A1 | 3/2021 | Heidari | |
| 2021/0406792 | A1* | 12/2021 | Bhardwaj | G06N 20/20 |
| 2022/0025753 | A1* | 1/2022 | Heidari | E21B 49/005 |
| 2022/0027538 | A1* | 1/2022 | Walters | G06F 30/28 |

FOREIGN PATENT DOCUMENTS

| | | | |
|---|---|---|---|
| WO | 2018117890 | A1 | 6/2018 |
| WO | 2018182444 | A1 | 10/2018 |
| WO | 2020236703 | A1 | 11/2020 |

OTHER PUBLICATIONS

Search Report and Written Opinion of International Patent Application No. PCT/U2023/068863 dated Oct. 17, 2023, 12 pages.

* cited by examiner

*Primary Examiner* — Michael R Reid
(74) *Attorney, Agent, or Firm* — Jeffrey D. Frantz

(57) ABSTRACT

A method can include checking states of valves of equipment with respect to a workflow specification according to a checking order defined by assigned numbers; responsive to the checking of the states of the valves, identifying individual valves that are not in a corresponding state as indicated by the workflow specification; and generating a sequence for changing the state of each of the individual valves that is not in its corresponding state to its corresponding state.

20 Claims, 22 Drawing Sheets

| 305 | | | 310 | | | 320 | | | | |
|---|---|---|---|---|---|---|---|---|---|---|
| | | | | | | F1 | F2 | F3 | F4 | FN |
| P | SH | SV | P | SH | SV | P | P | P | P | P |
| | | | | | | | | | | |
| | | | | | | | | | | |
| ⋮ | ⋮ | ⋮ | ⋮ | ⋮ | ⋮ | ⋮ | ⋮ | ⋮ | ⋮ | ⋮ |
| | | | | | | | | | | |

System 1110

GUI 1130

<Step X>

<A>
<State> All Valves Closed </State>
</A>

<B>
<State> All Valves Open </State>
</B>

<C>
<State> At Least One Valve Closed </State>
</C>

<D>
<State> All Valves Closed </State>
</D>

</Step X>

System 1300

GUI 1330

| | Tree State Advisor | | |
|---|---|---|---|
| | Arm | Expected State | Ready |
| | Master | At Least On Valve Closed | YES |
| | SWAB | All Valves Open | YES |
| Open | Pumpdown | All Valves Open | NO |
| Close | Flowback | All Valves Closed | NO |
| Close | Manifold | All Valves Closed | NO |

System 1600

GUI 1630

System 700

System 700

GUI 2010

GUI 2030

HYDRAULIC FRACTURING VALVE SYSTEM

RELATED APPLICATION

This application claims priority to and the benefit of a US Provisional Application having Ser. No. 63/354,661, filed 22 Jun. 2022, which is incorporated herein in its entirety.

BACKGROUND

A field operation can include fracturing of a formation, which can be, for example, a reservoir. As an example, a fracturing operation may be referred to as a fracturing job. Hydraulic fracturing (e.g., a stimulation treatment) may be performed on oil and gas wells in low-permeability reservoirs. For example, engineered fluids (e.g., including chemicals such as surfactants, polymers, polymeric surfactants, etc.) can be pumped at high pressure and rate into a reservoir interval to be treated where fracture generation and/or reopening occurs. As an example, wings of a fracture can extend away from a wellbore in opposing directions, for example, according to the natural stresses within the formation. An operation can utilize proppant, such as grains of sand of a particular size, mixed with treatment fluid to keep the fracture open when the treatment is complete. Hydraulic fracturing can aim to create high-conductivity communication with a large area of formation. While fracturing is mentioned as a type of field operation, various types of field operations can be performed with respect to a well. For example, consider a wireline operation, a maintenance operation, or a monitoring operation.

SUMMARY

A method can include checking states of valves of equipment with respect to a workflow specification according to a checking order defined by assigned numbers; responsive to the checking of the states of the valves, identifying individual valves that are not in a corresponding state as indicated by the workflow specification; and generating a sequence for changing the state of each of the individual valves that is not in its corresponding state to its corresponding state. A system can include a processor; a memory accessible to the processor; processor-executable instructions stored in the memory and executable to instruct the system to: check states of valves of equipment with respect to a workflow specification according to a checking order defined by assigned numbers; responsive to the check of the states of the valves, identify individual valves that are not in a corresponding state as indicated by the workflow specification; and issue a sequence of instructions for changing the state of each of the individual valves that is not in its corresponding state to its corresponding state. One or more non-transitory computer-readable storage media can include computer-executable instructions executable to instruct a computing system to: check states of valves of equipment with respect to a workflow specification according to a checking order defined by assigned numbers; responsive to the check of the states of the valves, identify individual valves that are not in a corresponding state as indicated by the workflow specification; and issue a sequence of instructions for changing the state of each of the individual valves that is not in its corresponding state to its corresponding state.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

DETAILED DESCRIPTION

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

Various field operations can include controllable equipment. For example, a controller can be operatively coupled to one or more pieces of equipment to control one or more actions thereof. As an example, a controller can provide for control of pumping equipment and, for example, measurement equipment, which can include one or more sensors. As mentioned, field operations can include fracturing operations, wireline operations, maintenance operations, monitoring operations, etc.

As to pumping fluid, consider, as an example, hydraulic fracturing operations that can include pumping fluid into a borehole in a formation to generate fractures in the formation. Such pumping can utilize a pump driven by an internal combustion engine where a drive shaft of the internal combustion engine can be operatively coupled to a transmission, which can include various gears that can gear-up or gear-down rotational speed of the drive shaft of the internal combustion engine in a manner that aims to effectively control a pump shaft to achieve one or more desirable pumping parameters (e.g., pump pressure, pump flow rate, etc.). While a single pump is mentioned, a field operation can involve a fleet of pumps where each pump may be mounted on a trailer along with an internal combustion engine and a transmission. A fleet operation can pump fluid to a manifold or manifolds, mixing equipment, etc. A fleet can include homogenous equipment or heterogeneous equipment. For example, a fleet can include a plurality of trailers that include equipment with common specifications or with at least some differing specifications. Further, even where equipment has common specifications, there can be differences in history and/or manufactured specifications from unit to unit, system to system, etc. In some instances, each pump system in a fleet may differ and possess its own characteristics, peculiarities, behaviors, etc. Such a fleet can make unified control problematic, which can result in sub-optimal pumping, suboptimal hydraulic fracture generation, suboptimal equipment usage, etc.

Figure 1:
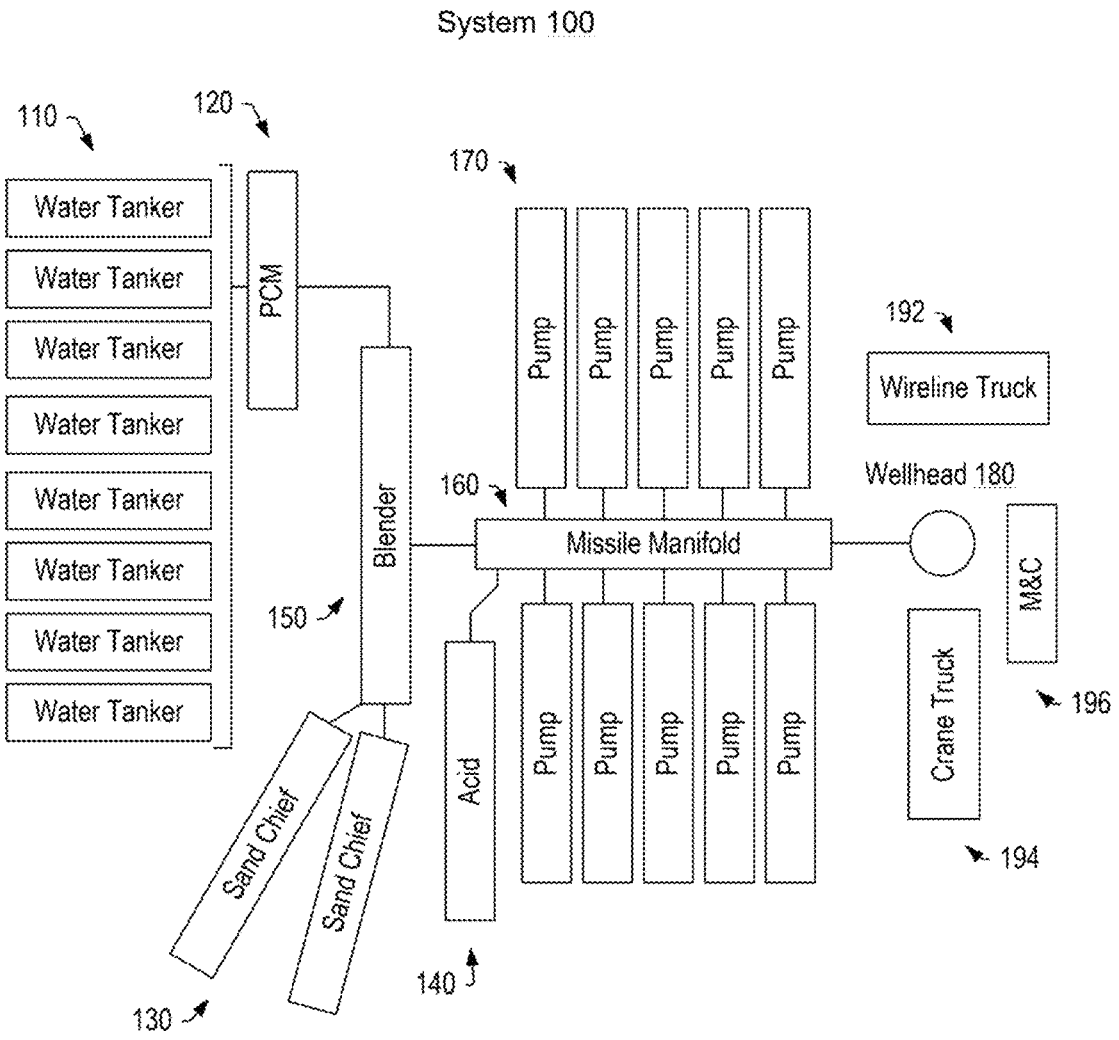
FIG. 1 illustrates an example of a system for field operations.

FIG. 1 shows an example of a system 100 that includes water tankers 110, a precision continuous mixer (PCM) 120, one or more sand chiefs 130, an optional acid and/or other chemical supply 140, a blender 150, a missile manifold 160, and a fleet of pump systems 170. The pump systems 170 are operatively coupled to the missile manifold 160, which is supplied with fluid via at least the PCM 120 and the blender 150, which may receive fluid from one or more of the water tankers 110, which can include conduits operatively coupled via a manifold or manifolds. As shown, the system 100 can provide for output of blended fluid, optionally with solids (e.g., sand as proppant, etc.) and optionally with chemicals (e.g., surfactant, acid, etc.), to a wellhead, which is a wellhead 180 to at least a partially completed well (e.g., with one or more completion components). As an example, hydraulic fracturing can be performed using the system 100. At the wellhead 180, various types of equipment may be present such as a wireline truck 192, a crane truck 194 and monitoring and/or control (M&C) equipment 196.

Figure 2:
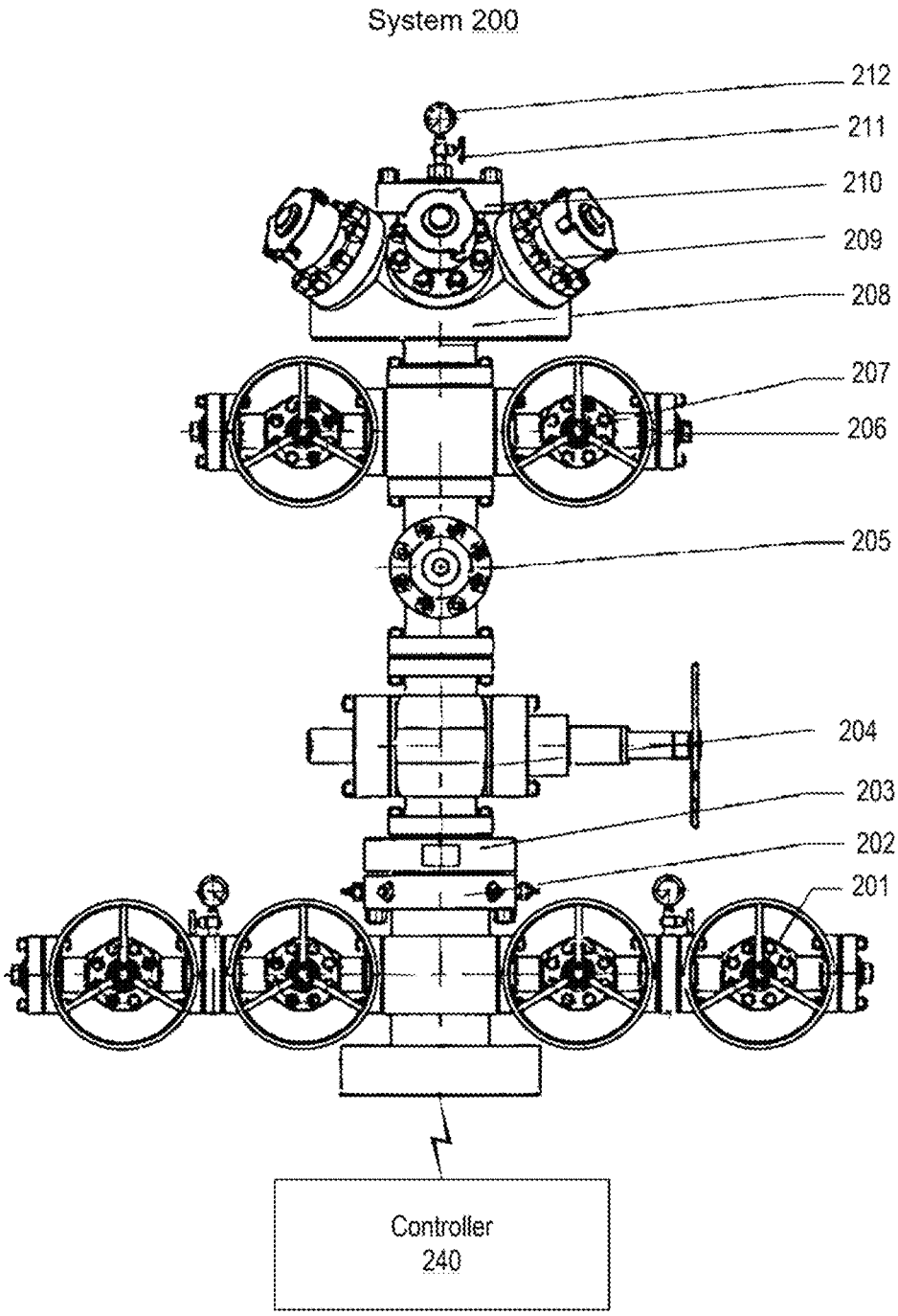
FIG. 2 illustrates an example of a system for field operations.

FIG. 2 shows an example of a system 200 that can be referred to as a frac tree. The system 200 can be a wellhead structure that can include various features arranged in various manners, which can depend on operational tasks, etc. As shown in the example of FIG. 2, the system can include a tubing head gate valve 201, a tubing head 202, an adapter flange 203, a master manual flat gate valve 204, a master hydraulic flat gate valve 205, a cross 206, a wing gate valve 207, a fracturing head 208, a union 209, a vertical port 210, a check valve 211, a pressure gauge 212 (e.g., a pressure sensor), etc. As shown, a controller 240 can be part of the system 200 or operatively coupled to one or more components of the system 200.

A system such as, for example, the system 200 or a portion thereof can be present as part of the system 100 of FIG. 1. The system 200 includes various features that can be considered manual features where, for example, an operator can adjust one or more of such features by hand. For example, consider manual valves with hand wheels that can be turned. In various examples, one or more mechanisms may be provided for automated operation and/or remote operation. For example, consider one or more hydraulic valves that can be adjusted via a hydraulic control system. As an example, a field may include one or more of manual valves, hydraulic valves, etc.

The system 200 can be a frac tree that is also a Christmas tree installed specifically for a fracturing process. A frac tree can include upper and lower master valves, a flow cross, wing valves, a goat head, and a swab valve. Frac trees can have larger bores and higher pressure ratings than production trees to accommodate the high flow rates and pressures for hydraulic fracturing. A frac tree can include a vertical bore accessible at the top of the frac tree that is suitable for deployment of equipment downhole into a well. For example, consider wireline, conduit (e.g., tubing), etc., which may be limited in an ability to bend such that a vertical insertion is appropriate via a top of a frac tree. As an example, a frac tree may be a composite frac tree in which multiple frac valves are included on a single large body where overall height of the frac tree may be reduced.

At a site, various types of valves may be utilized in combination with various types of equipment. For example, consider manifolds, missiles, a valve greasing system, valve actuators, etc. As an example, the controller 240 can provide for managing control operations of various valves. As an example, the controller 240 can include features of a valve commander framework.

A controller may help to expedite workflows such as, for example, expediting workflows in a manner that can increase number of stages completed per day. Such a controller may also provide safety and logic features that can help to assure a workflow is performed properly (e.g., according to one or more standard operating procedures (SOPs)). A controller can utilize a digital, computational framework to help streamline the process of operating valves on a frac tree and/or a manifold during single and/or multiwell fracturing operations (e.g., consider zipper fracs, etc.).

Various workflows may be implemented with assistance of a controller. For example, consider workflows that utilize wireline and fracturing crews that may alternate operations between wells to isolate a well and rig up wireline or to open a well to begin pumping fluids downhole. During such complicated operations, valves are to be opened and closed accurately and in proper sequence (e.g., according to one or more operating procedure specification, etc.). Operating the wrong valve at the wrong time can have detrimental consequences, for example, in terms of non-productive time (NPT), costs, and health, safety and environment (HSE) impacts.

A controller with a framework can provide an operator with an ability to digitally control frac valves with the click of a button (e.g., from inside a control cabin, inside a vehicle, in the field, etc.). Such a controller can also monitor valve position in real time, throughout an operation for various valves. A controller can streamline operations, for example, to make the process of opening and closing valves nearly instantaneous, as may be appropriate for various operations, workflows, etc.

As an example, various safety interlocks between well stimulation and well control equipment can be provided that may, for example, help to prevent overpressuring or washing out of one or more frac valves. As an example, a system can include instrumentation that can detect whether a wireline toolstring has safely cleared frac tree valves, which may help to reduce risk of cut wireline (e.g., consider inappropriate closure of a valve that may damage wireline).

As an example, a controller can utilize a computational framework that includes advisory features such as a digital advisor, which may help to ensure that a workflow is executed according to a job plan. A controller can help to keep personnel out of a high-pressure zone (e.g., high water pressure achieved by pumping) during stimulation operations. As an example, a system can include hydraulically actuated valves that can be operated from outside the high-pressure zone. As an example, a frac site may utilize one or more hydraulic power units (HPUs) per well to actuate frac valves. As an example, a controller can reduce the number of HPUs to operate the same number of valves, which can reduce fuel usage and carbon emissions.

As an example, a workflow may involve use of one or more simulators. For example, consider the VISAGE geomechanics simulator (SLB, Houston Texas) or the PIPESIM network simulator (SLB, Houston Texas), etc. The VISAGE simulator includes finite element numerical solvers that can provide simulation results such as, for example, results as to compaction and subsidence of a geologic environment, well and completion integrity in a geologic environment, caprock and fault-seal integrity in a geologic environment, fracture behavior in a geologic environment, thermal recovery in a geologic environment, CO2 disposal, etc. The PIPESIM simulator includes solvers that can provide simulation results such as, for example, multiphase flow results (e.g., from a reservoir to a wellhead and beyond, etc.), flowline and surface facility performance, etc. The PIPESIM simulator may be integrated, for example, with the AVOCET production operations framework (SLB, Houston, Texas). As an example, the KINETIX reservoir-centric stimulation-to-production framework (SLB, Houston, Texas) may be utilized, which can integrate geology, petrophysics, completion engineering, reservoir engineering, and geomechanics for tasks such as optimization of completions, fracturing designs for a well, a pad, or a whole field, etc. As an example, from 1D logs and geometric completions to full 3D mechanical and petrophysical models coupled with the INTERSECT reservoir simulator and VISAGE finite-element geomechanics simulator, the KINETIX framework provides various options for various workflows. For example, the KINETIX framework can provide for automated parallel processing in the cloud, for example, to facilitate rapid assessment of well spacing, completion, and treatment design choices (e.g., to explore thousands of scenarios in hours rather than weeks). One or more of such simulators may provide for simulation of hydraulic fracturing, simulation of fluid flow, etc., which may be utilized in planning, control, assessment, etc., of one or more hydraulic fracturing operations.

As an example, a simulator may utilize one or more mechanical earth models (e.g., "MEMs", 3D earth models, etc.) that can be generated from a variety of geologic, petrophysical, geomechanical, and geophysical information that may, for example, help to characterize complexity and heterogeneity of a reservoir and completion properties in one or more formations of interest. As an example, data can be acquired via one or more of 3D seismic surveys, acoustic impedance and other seismic-derived property volumes (e.g., bulk modulus, Poisson's ratio, etc.), microseismic surveys, sonic logs, rock cores, burial history, petrophysical measurements from well logs, etc. As an example, natural fracture patterns and regional stress field may be mapped using such multi-domain, multi-scale information as borehole images and 2D and 3D seismic surveys, which can then be used to develop and calibrate fracture propagation models. As an example, a mechanical earth model (MEM) may be used to generate maps to asses, perform, etc., one or more of drilling, fracturing, and operational risks.

Figure 3:
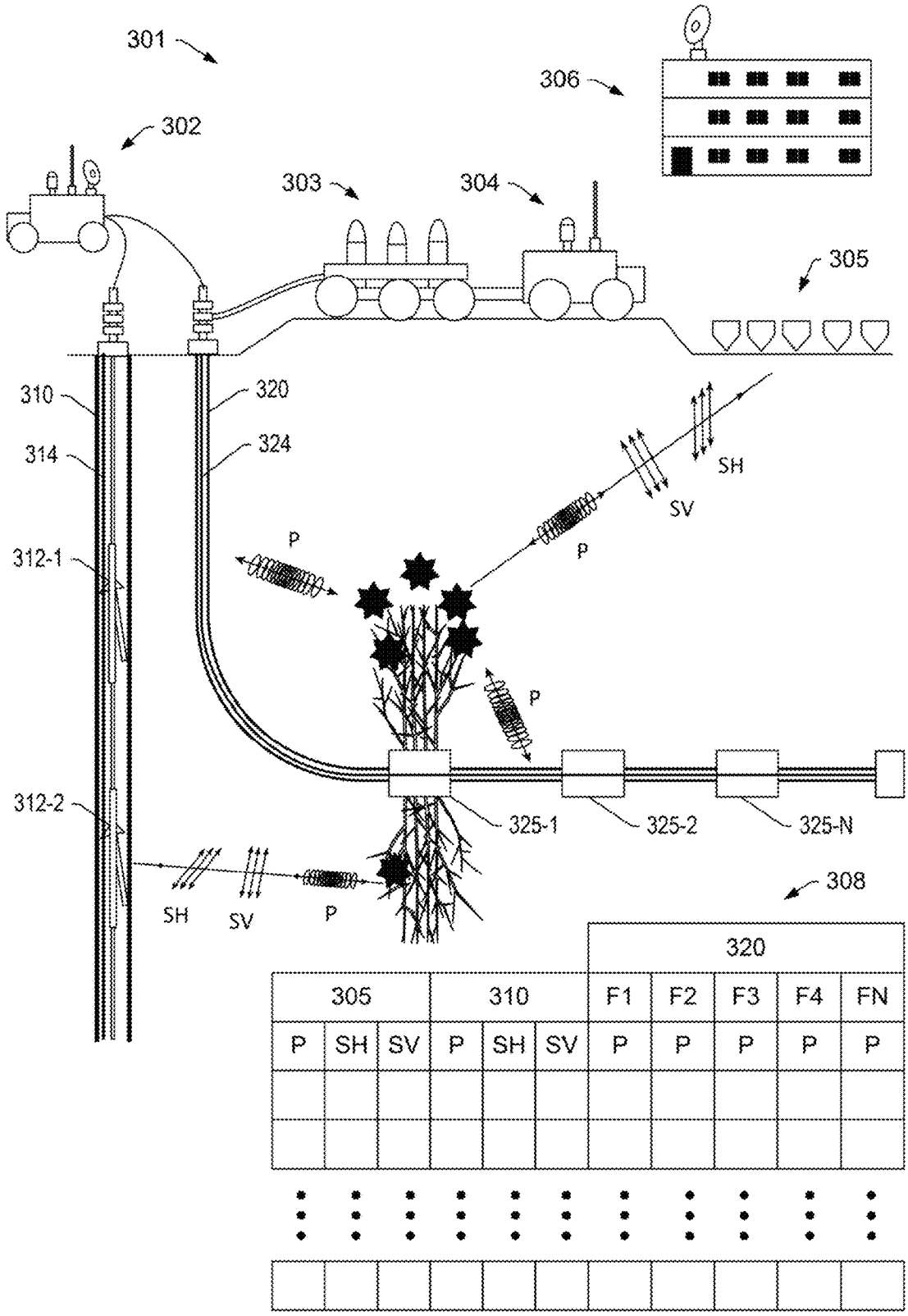
FIG. 3 illustrates an example of a system for field operations.

FIG. 3 shows an example of a geologic environment 301 that includes monitoring equipment 302, a pump 303, equipment 304, a seismic sensor or receiver array 305 and a remote facility 306. As shown, various types of communication may be implemented such that one or more pieces of equipment can communicate with one or more other pieces of equipment. As an example, equipment can include geopositioning equipment (e.g., GPS, etc.). As an example, equipment can include one or more satellites and one or more satellite links (e.g., dishes, antennas, etc.).

In the example of FIG. 3, a monitoring well 310 and a treatment well 320 are disposed in the geologic environment 301. The monitoring well 310 includes a plurality of sensors 312-1 and 312-2 and optionally a fiber cable sensor 314 and the treatment well 320 optionally includes a fiber cable sensor 324 and one or more sets of perforations 325-1, 325-2, 325-N, as generated by perforating equipment, which may utilize force generated via one or more mechanisms. As an example, perforating equipment may utilize wireline and may be considered wireline equipment, which may be deployed via a frac tree.

Equipment in the example of FIG. 3 can be utilized to perform one or more methods (e.g., field operations, etc.). As an example, data associated with hydraulic fracturing events may be acquired via various sensors. As an example, P-wave data (compressional wave data) can be utilized to assess such events (e.g., microseismic events). Such information may allow for adjusting one or more field operations. As an example, data acquired via the fiber cable sensor 324 can be utilized to generate information germane to a fluid flow-based treatment process (e.g., to determine where fluid pumped into a well may be flowing, etc.).

FIG. 3 shows an example of a table or data structure 308 with some examples of information that may be acquired via the seismic sensor array 305 (e.g., P-wave as "P", SH-wave as "SH", SV-wave as "SV"), sensors of the monitoring well 810 (e.g., P, SH, SV) and sensors of the treatment well 320 (e.g., P). In the example of FIG. 3, information may be sensed with respect to position, for example, sensor position, position along a fiber cable sensor, etc. As shown, the fiber cable sensor 324 may sense information at a variety of positions along the fiber cable sensor 324 within the treatment well 320 (see, e.g., F1, F2, F3, F4 to FN).

In the example of FIG. 3, the set of perforations 325-1 are shown as including associated fractures and microseismic events that generate energy that can be sensed by various sensors in the geologic environment 301. Arrows indicate a type of wave that may be sensed by an associate sensor. For example, as mentioned with respect to the table or data structure 308, the seismic sensor array 305 can sense P, SV and SH waves while the fiber cable sensor 324 can sense P waves.

As an example, the equipment 302 can be operatively coupled to various sensors in the monitor well 310 and the treatment well 320. As an example, the equipment 302 may be on-site where wires are coupled from sensors to the equipment 302, which may be vehicle-based equipment (e.g., a data acquisition and/or control truck, etc.). As an example, the equipment 304 may control the pump 303 (e.g., or pumps) that can direct fluid into the treatment well 320. For example, a line is shown as a conduit that is operatively coupled between the pump 303 and the treatment well 320.

As an example, information acquired by the equipment 302 may be utilized to control one or more treatment processes controlled by the equipment 304. For example, the equipment 302 and the equipment 304 may be in direct and/or indirect communication via one or more communication links (e.g., wire, wireless, local, remote, etc.). In such an example, information acquired during a treatment process can be utilized in real-time (e.g., near real-time) to control the treatment process. For example, the equipment 302 can acquire data via sensors in the wells 310 and 320 and output information to the equipment 304 for purposes of controlling an on-going treatment process. As an example, such information may be utilized to control and/or to plan a subsequent treatment process, for example, additionally or alternatively to controlling an on-going treatment process.

As to a hydraulic fracturing process, where fluid pressure is monitored, a sudden drop in pressure can indicate fracture initiation of a stimulation treatment, as fluid flows into the fractured formation. As an example, to break rock in a target interval, fracture initiation pressure exceeds a sum of the minimum principal stress plus the tensile strength of the rock. To determine fracture closure pressure, a process may allow pressure to subside until it indicates that a fracture has closed. A fracture reopening pressure may be determined by pressurizing a zone until a leveling of pressure indicates the fracture has reopened. The closure and reopening pressures tend to be controlled by the minimum principal compressive stress (e.g., where induced downhole pressures exceed minimum principal stress to extend fracture length).

After performing fracture initiation, a zone may be pressurized for furthering stimulation treatment. As an example, a zone may be pressurized to a fracture propagation pressure, which is greater than a fracture closure pressure. The difference may be referred to as the net pressure, which represents a sum of frictional pressure drop and fracture-tip resistance to propagation (e.g., further propagation).

Figure 4:
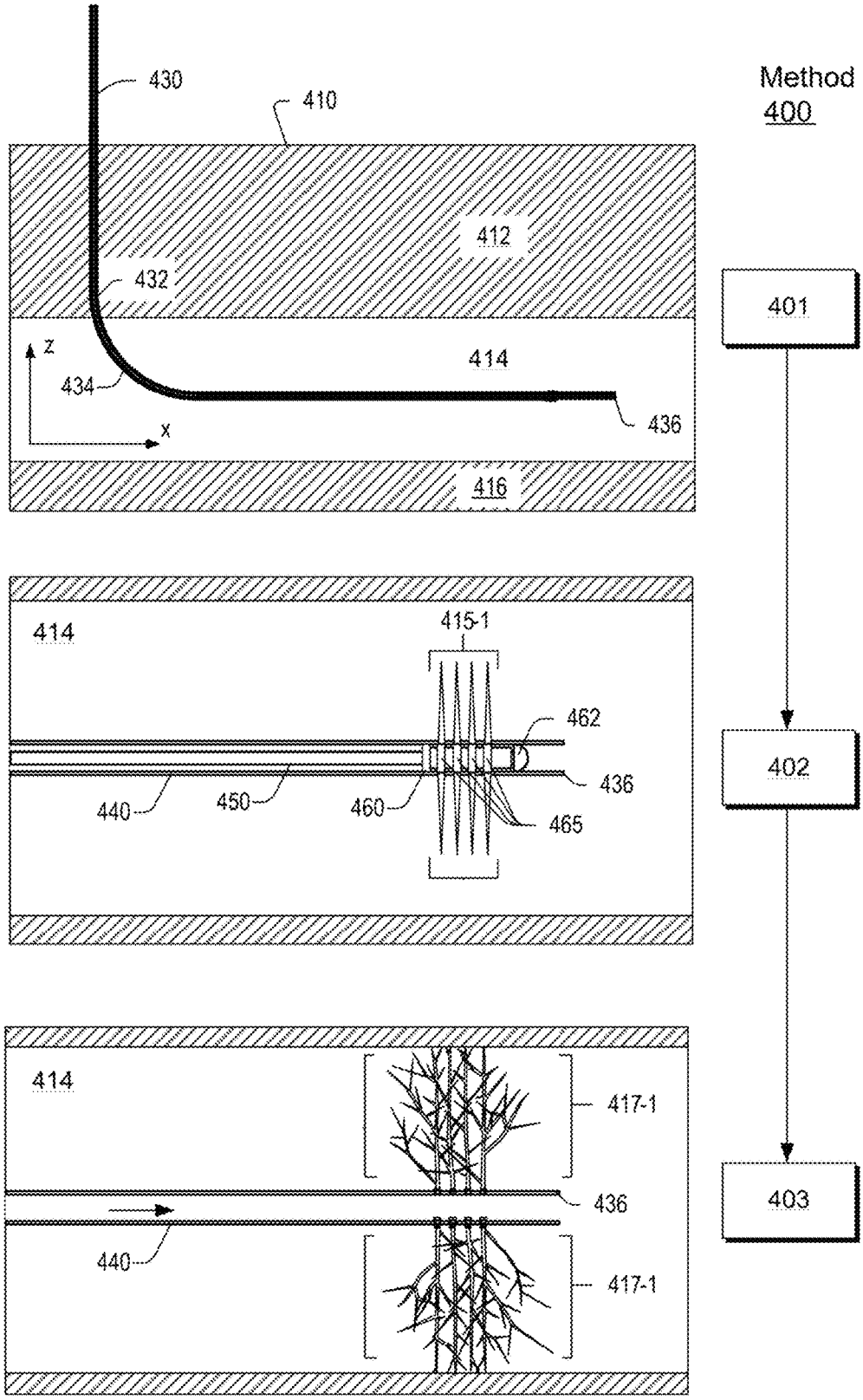
FIG. 4 illustrates an example of a portion of a method.
Figure 5:
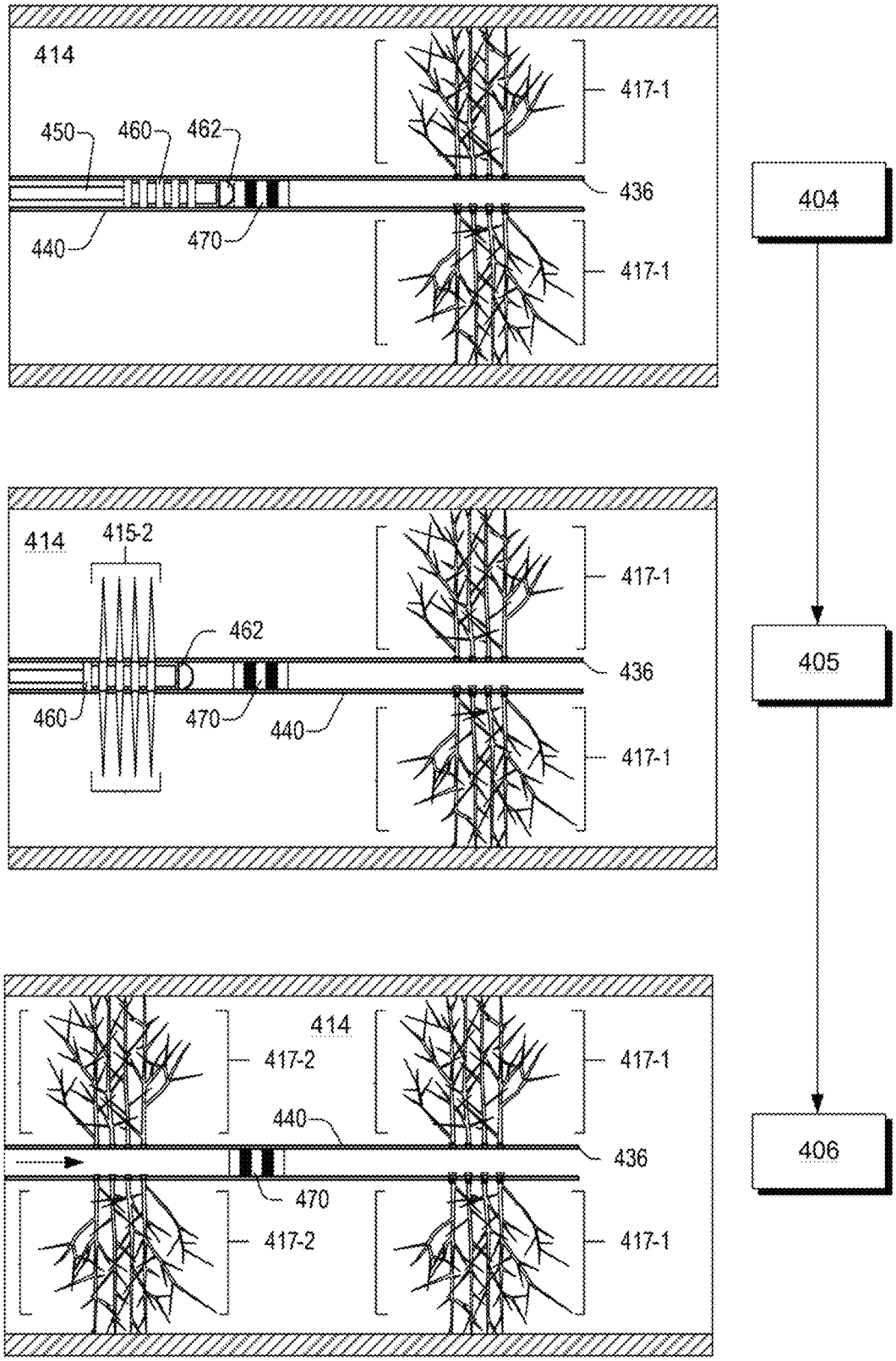
FIG. 5 illustrates an example of a portion of the method of FIG. 4.

FIGS. 4 and 5 show an example of a method 400 that includes generating fractures. As shown, the method 400 can include various operational blocks such as one or more of the blocks 401, 402, 403, 404, 405 and 406. The block 401 may be a drilling block that includes drilling into a formation 410 that includes layers 412, 414 and 416 to form a bore 430 with a kickoff 432 to a portion defined by a heel 434 and a toe 436, for example, within the layer 414.

As illustrated with respect to the block 402, the bore 430 may be at least partially cased with casing 440 into which a string or line 450 (e.g., wireline) may be introduced that carries a perforator 460. As shown, the perforator 460 can include a distal end 462 and charge positions 465 associated with activatable charges that can perforate the casing 440 and form channels 415-1 in the layer 414. Next, per the block 403, fluid may be introduced into the bore 430 between the heel 434 and the toe 436 where the fluid passes through the perforations in the casing 440 and into the channels 415-1. Where such fluid is under pressure, the pressure may be sufficient to fracture the layer 414, for example, to form fractures 417-1. In the block 403, the fractures 417-1 may be first stage fractures, for example, of a multistage fracturing operation.

Per the block 404, additional operations are performed for further fracturing of the layer 414. For example, a plug 470 may be introduced into the bore 430 between the heel 434 and the toe 436 and positioned, for example, in a region between first stage perforations of the casing 440 and the heel 434. Per the block 405, the perforator 460 may be activated to form additional perforations in the casing 440 (e.g., second stage perforations) as well as channels 415-2 in the layer 414 (e.g., second stage channels). Per the block 406, fluid may be introduced while the plug 470 is disposed in the bore 430, for example, to isolate a portion of the bore 430 such that fluid pressure may build to a level sufficient to form fractures 417-2 in the layer 414 (e.g., second stage fractures).

In a method such as the method 400 of FIGS. 4 and 5, it may be desirable that a plug (e.g., the plug 470) includes properties suited to one or more operations. Properties of a plug may include mechanical properties (e.g., sufficient strength to withstand pressure associated with fracture generation, etc.) and may include one or more other types of properties (e.g., chemical, electrical, etc.). As an example, it may be desirable that a plug degrades, that a plug seat degrades, that at least a portion of a borehole tool degrades, etc. For example, a plug may be manufactured with properties such that the plug withstands, for a period of time, conditions associated with an operation and then degrades (e.g., when exposed to one or more conditions). In such an example, where the plug acts to block a passage for an operation, upon degradation, the passage may become unblocked, which may allow for one or more subsequent operations.

Figure 6:
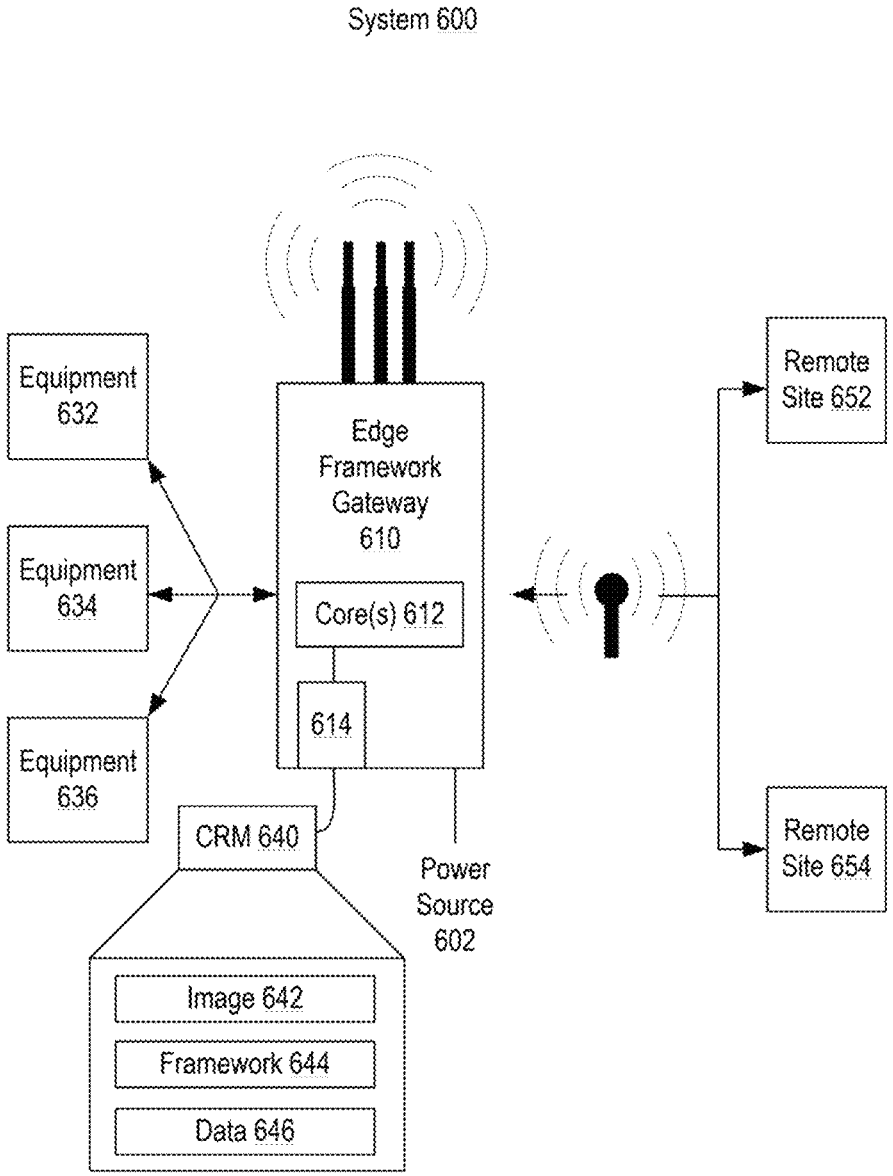
FIG. 6 illustrates an example of a system.

FIG. 6 shows an example of a system 600 that can include a power source 602 (e.g., solar, generator, batter, grid, etc.) that can provide power to an edge framework gateway 610 that can include one or more computing cores 612 and one or more media interfaces 614 that can, for example, receive a computer-readable medium 640 that may include one or more data structures such as an image 642, a framework 644 and data 646. In such an example, the image 642 may be an operating system image that can cause one or more of the one or more cores 612 to establish an operating system environment that is suitable for execution of one or more applications. For example, the framework 644 may be an application suitable for execution in an established operating system in the edge framework gateway 610.

In the example of FIG. 6, the edge framework gateway 610 ("EF") can include one or more types of interfaces suitable for receipt and/or transmission of information. For example, consider one or more wireless interfaces that may provide for local communications at a site such as to one or more pieces of local equipment 632, 634 and 636 and/or remote communications to one or more remote sites 652 and 654.

As an example, the EF 610 may be installed at a site that is some distance from a city, a town, etc. In such an example, the EF 610 may be accessible via a satellite communication network and/or one or more networks.

As shown in FIG. 6, an EF may execute within a gateway such as, for example, an AGORA gateway (e.g., consider one or more processors, memory, etc., which may be deployed as a "box" that can be locally powered and that can communicate locally with other equipment via one or more interfaces). As an example, one or more pieces of equipment may include computational resources that can be akin to those of an AGORA gateway or more or less than those of an AGORA gateway. As an example, an AGORA gateway may be a network device.

As an example, a gateway can include one or more features of an AGORA gateway (e.g., v.202, v.402, etc.) and/or another gateway. For example, consider an INTEL ATOM E3930 or E3950 Dual Core with DRAM and an eMMC and/or SSD. Such a gateway may include a trusted platform module (TPM), which can provide for secure and measured boot support (e.g., via hashes, etc.). A gateway may include one or more interfaces (e.g., Ethernet, RS485/422, RS232, etc.). As to power, a gateway may consume less than about 100 W (e.g., consider less than 10 W or less than 20 W). As an example, a gateway may include an operating system (e.g., consider LINUX DEBIAN LTS). As an example, a gateway may include a cellular interface (e.g., 4G LTE with Global Modem/GPS, etc.). As an example, a gateway may include a WIFI interface (e.g., 802.11 a/b/g/n). As an example, a gateway may be operable using AC 100-240 V, 50/60 Hz or 24 VDC. As to dimensions, consider a gateway that has a protective box with dimensions of approximately 10 in×8 in×4 in (e.g., 25 cm×20.3 cm×10.1 cm).

As an example, the EF 610 of FIG. 6 may be utilized as a controller such as, for example, the controller 240 of FIG. 2 where the equipment 632, 634 and 636 in FIG. 6 can include one or more components of a frac tree, a manifold, etc. As an example, an operator at the edge can interface with features of an EF using a mobile computing device (e.g., smartphone, tablet, notebook, etc.) and/or another type of computing device, which may be mobile or fixed (e.g., consider a computing device in a vehicle, in a building, etc.), and in communication via a network or networks.

Figure 7:
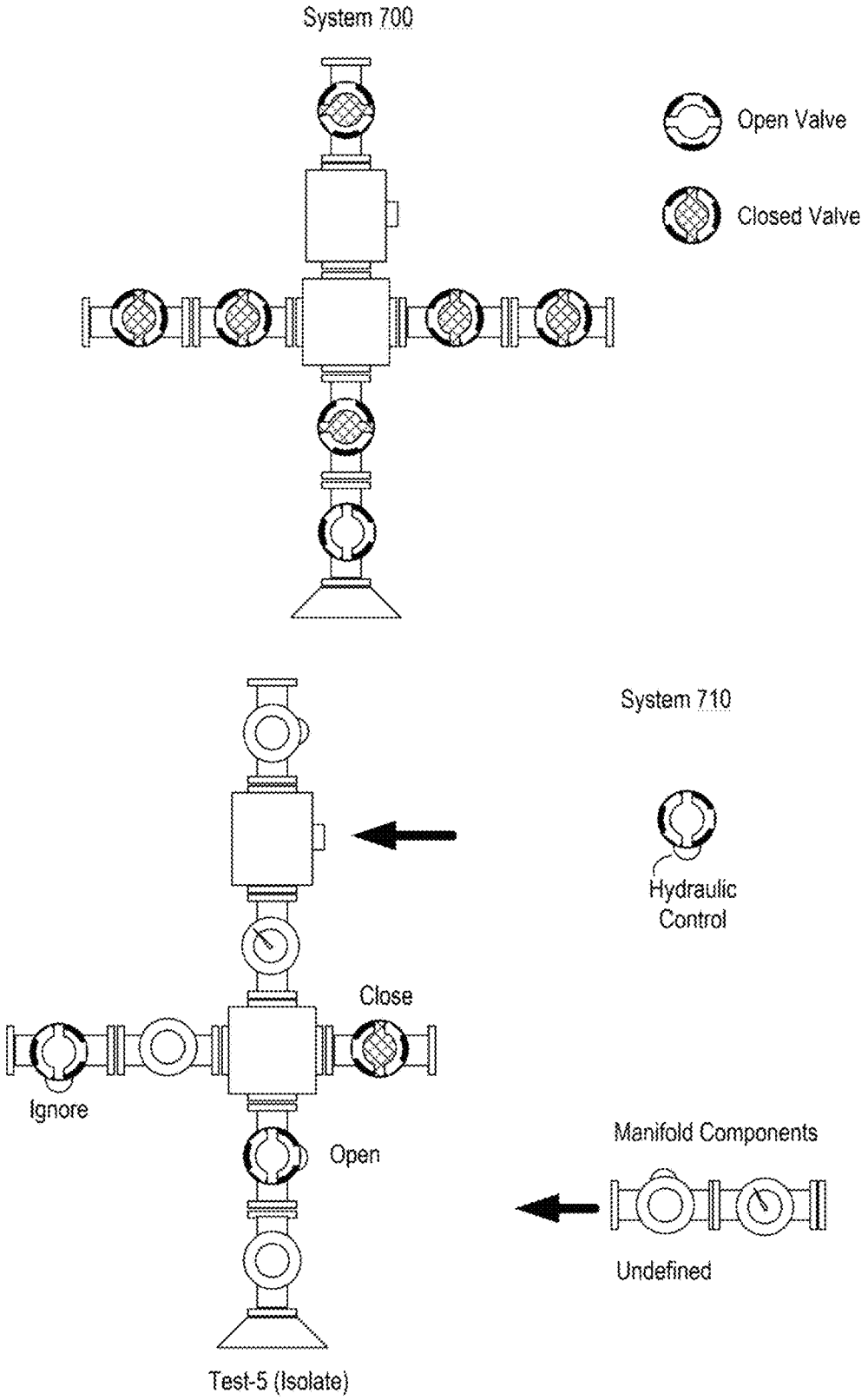
FIG. 7 illustrates examples of systems.

FIG. 7 shows an example of a system 700 that can be rendered to a display as part of one or more graphical user interfaces (GUIs). As shown, the system 700 can include a number of valves where each of the valves can be in a particular position or state such as, for example, open or closed, where open can include one or more degrees of open (e.g., 10% open, 50% open, 90% open, etc.). When a valve is closed, fluid communication is shunted such that fluid does not flow via the valve. FIG. 7 also shows an example of a system 710 where manifold components are also included. As shown, valves can be defined for purposes of control, monitoring, planning, etc. For example, a controller can receive valve definitions and/or automatically define valves for a given system. As an example, a controller may facilitate construction of a frac tree and/or other equipment in a framework where states can be assigned to valves, which may be via user interaction and/or via signals (e.g., wired signals and/or wireless signals). For example, the EF 610 may be operatively coupled to one or more valves, valve actuators, valve sensors, etc.

In FIG. 7, graphics are shown to indicate an open valve, a closed valve, a hydraulic control feature that makes a valve hydraulically controllable (e.g., by a hydraulic controller, etc.), an undefined valve and a gauge (e.g., a sensor), as indicated by a gauge face with a needle. As to the system 710, it is shown as being labeled "Test-5", which is in an "isolate" configuration, where one valve is labeled as "closed", another value is labeled as "opened" and yet another valve is labeled as "ignore". As explained, for a field operation, operating procedure specifications can provide for a state of a frac tree (e.g., a set of valves, etc.), where, for example, to achieve that state, a particular transition order is to be followed, which can depend on an existing state of the frac tree (e.g., as may be associated with a previously performed operation, a default state, a waiting state, etc.).

As explained, a frac tree is a flow control structure installed on a wellhead during stimulation jobs. A frac tree may include a combination of hydraulic valves and manual valves. With combinations of open/close valves, different flow paths can be created to support corresponding activities during a stimulation workflow. As explained, a frac tree can include a straight portion that can align with a wellbore such that equipment can be disposed in at least a vertical portion of the wellbore without bending of the equipment. As explained, a frac tree can also include one or more branches or arms, which may form a cross-like shape, which may be utilized for one or more fluid flow related operations, for example, where a straight, line-of-sight, entrance or exit from a vertical portion of a wellbore is not necessarily required.

Figure 8:
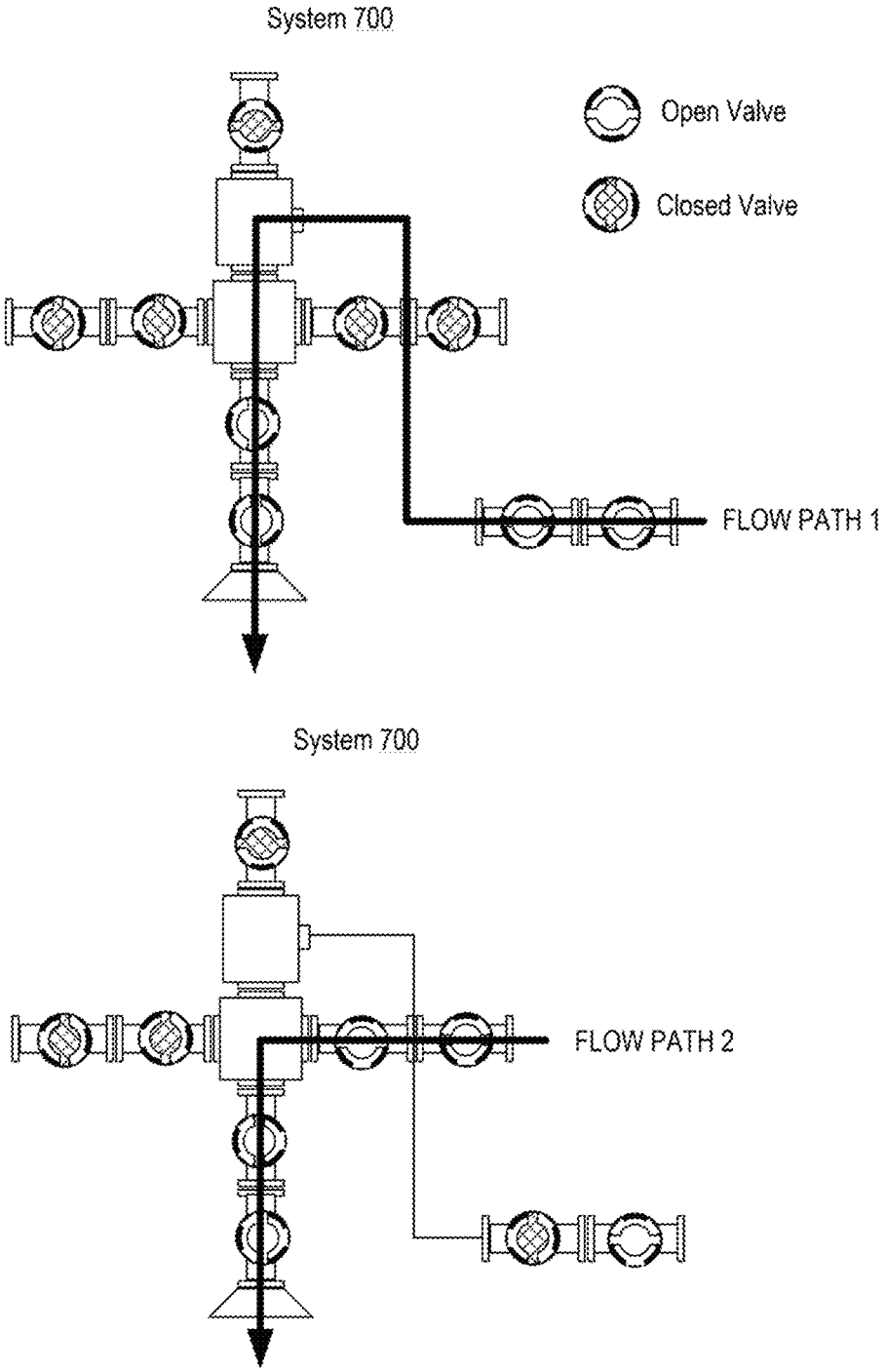
FIG. 8 illustrates examples of a system.

FIG. 8 shows the system 700 with particular valves in particular states to create a first flow path (e.g., Flow Path 1) and to create a second flow path (e.g., Flow Path 2). In the examples of FIG. 8, the two different flow paths can support different activities during a stimulation operation. In various instances, stimulation activities can be repeated on a well multiple times, for example, for tens or even over one hundred times. As explained, fracturing may occur in stages where a cycle is performed for each stage, which may last a few hours and where various valves are to be opened and/or closed from time to time during the operation.

As an example, a workflow can have different valve state expectations at certain locations on a frac tree according to a desired flow path. For example, consider isolation where the flow paths are closed; pressure testing where a flow path is opened to allow for pressurized fluid to flow into a frac tree for leakage detection; and open well where a flow path is opened to allow for stimulation fluid to enter a wellbore.

Figure 9:
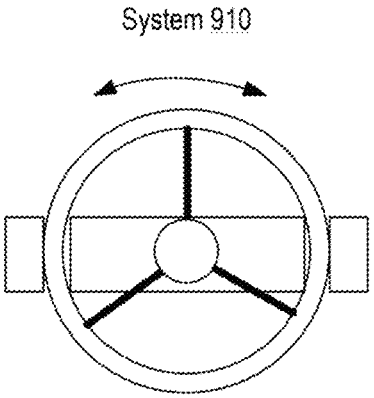
FIG. 9 illustrates examples of systems.
Figure 9:
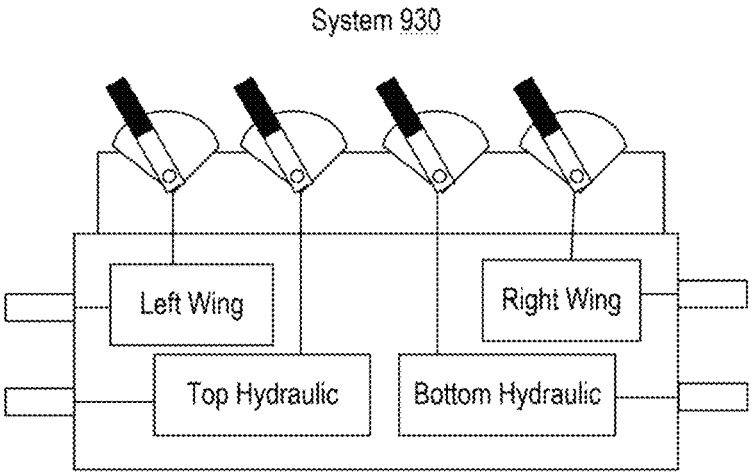

FIG. 9 shows some examples of equipment 910 and 930 where the equipment 910 involves manual valve operation (e.g., via rotation of a hand wheel) and where the equipment 930 includes hydraulic valve operation (e.g., via an H P U), which may include manual levers and/or actuators that can be controlled. In various instances, when an operator receives an order to create or close a flow path for different activities in a stage, he/she directly moves a manual valve with a handle or wheel; whereas, to move a hydraulic valve, an operator may utilize a lever (e.g., a handle) on an HPU. As explained, the controller 240, the EF 610, etc., may provide for automated and/or semi-automated control of one or more valves.

Figure 10:
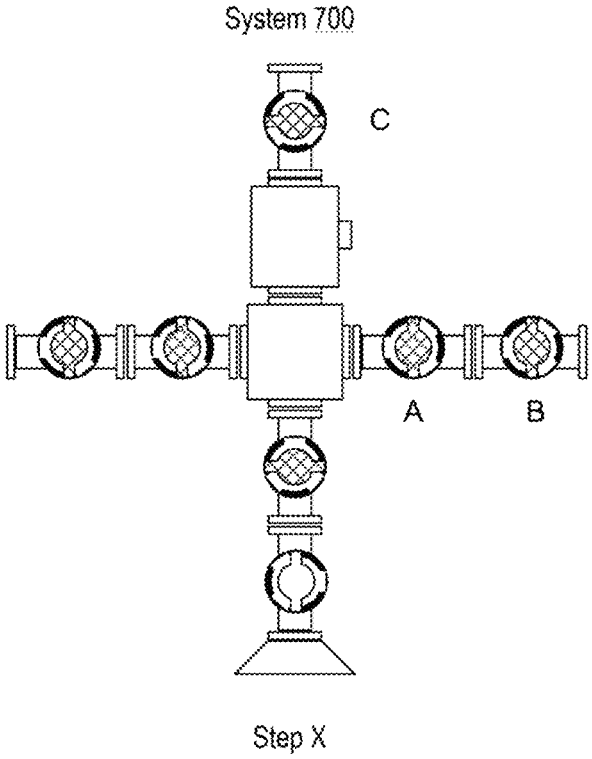
FIG. 10 illustrates examples of a system.
Figure 10:
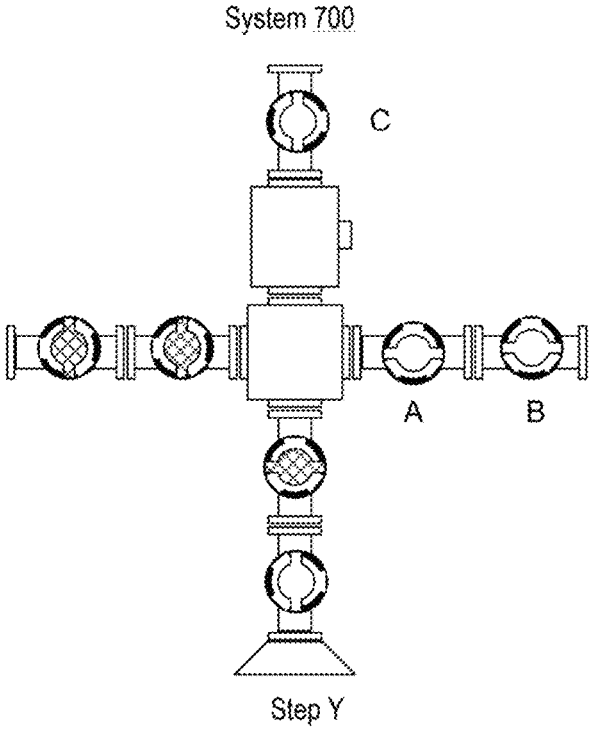

FIG. 10 shows the system 700 in two different states, which can be defined by expected states of valves on a frac tree at different operational points (e.g., according to operational specifications, which can be workflow specifications). In the example of FIG. 10, when an operation shifts from step X (top) to step Y (bottom), valves A, B and C are to be opened; and, when the operation shifts from step Y (bottom) and step X (top), those three valves are to be closed.

When such valve state changes are performed manually, human error is possible as the correct valve or the correct handle on the HPU must be selected before the state of the valve can be changed. Furthermore, there may be no direct feedback about the valve status so that human error might not be detected within a sufficient period of time (e.g., a valve may not include a sensor or detector that can sense or detect its current state). Additionally, there may be a requirement as to the order of valve state change. For example, from step X to step Y, the valves are to be opened in according to a specific sequence of C A B and the order would be C B A vice versa.

In various instances, logic of a sequence may not be apparent without consideration of flow, pressures, equipment capabilities, etc. Further, a forward sequence and a backward sequence can differ. Logic of valve adjustments can depend on various factors, which may not be readily apparent to a human operator, particularly in an environment with hazards where time can be a factor. Hence, a computational framework that can ease human demands and help to assure compliance with specifications can improve field operations while reducing risks and, for example, allowing for recording of actions taken.

As an example, a framework can account for changes such that the framework can enforce a valve state change sequence to achieve an expected state on each valve in various steps of operation as a "control workflow". Such a framework can provide valve operation standardization for systems with frac tree valves and optionally manifold valves. For example, a change to state of a valve may be prohibited until one or more frac tree valves are in a particular state, which may be one of one or more acceptable states. As explained, logic and acceptable states may not be readily apparent to a human operator, particularly where, as mentioned, various states are possible in an environment where many state changes may be expected in performing field operations.

Figure 11:
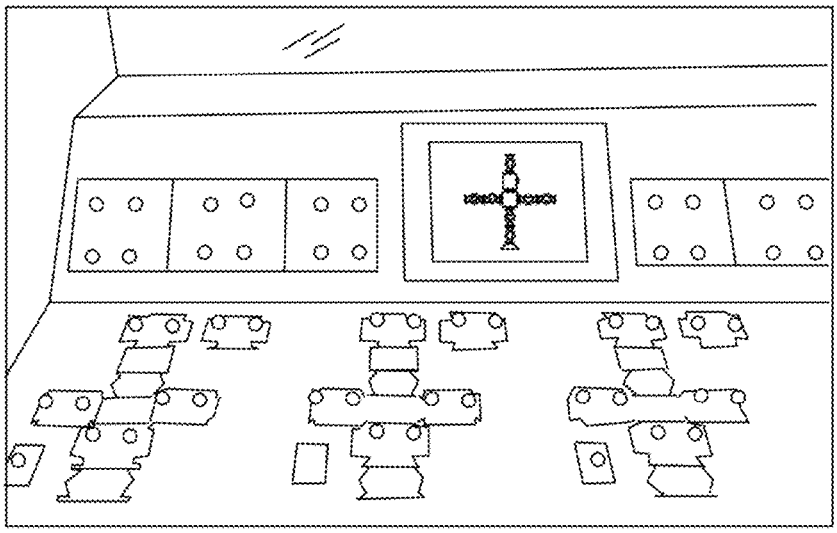
FIG. 11 illustrates an example of a system and an example of a graphical user interface (GUI)
Figure 11:
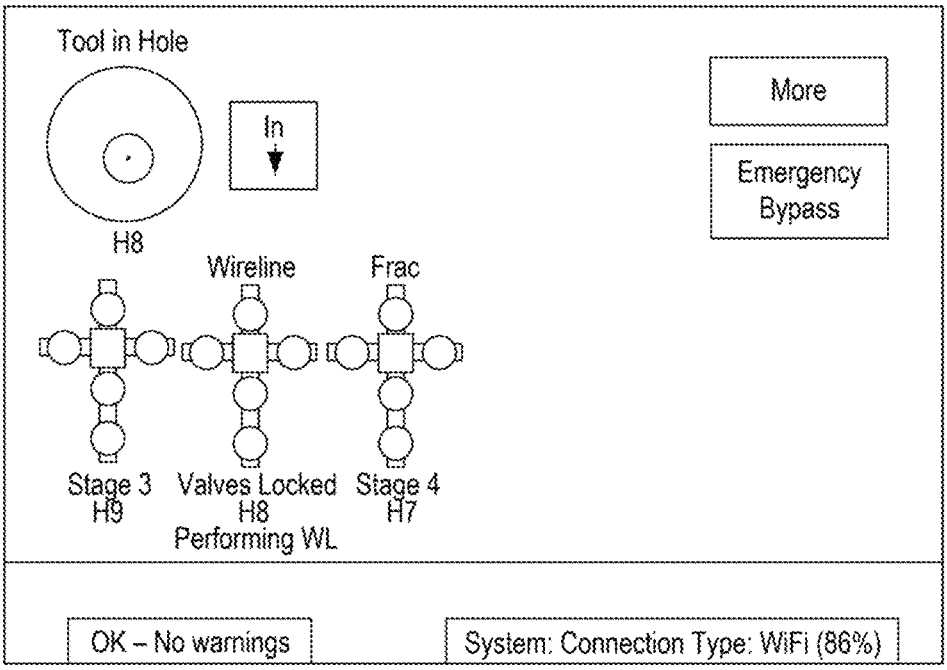

FIG. 11 shows an example of a system 1110 and an example of a GUI 1130 where hydraulic valve operation may be performed using a control panel of a controller. In such an approach, valve state feedback and a visual presentation of valves/frac tree can be presented to an operator. A monitoring and control panel can be provided; however, valve movements may appear as being arbitrary. Therefore, the system 1110 may lack features for standardizing valve movement between different steps of an operation. As to the GUI 1130, it provides information as to safety interlocks (e.g., information and associated control graphics that are to be addressed before valve control action can be initiated), as may be implemented by monitoring status of a stimulation operation and applying the safety interlocks to prevent certain types of unsafe valve state changes. However, such an approach may be relatively narrow in focus such as focusing on certain steps in an operation without enforcing a control workflow through an entire operation.

Figure 12:
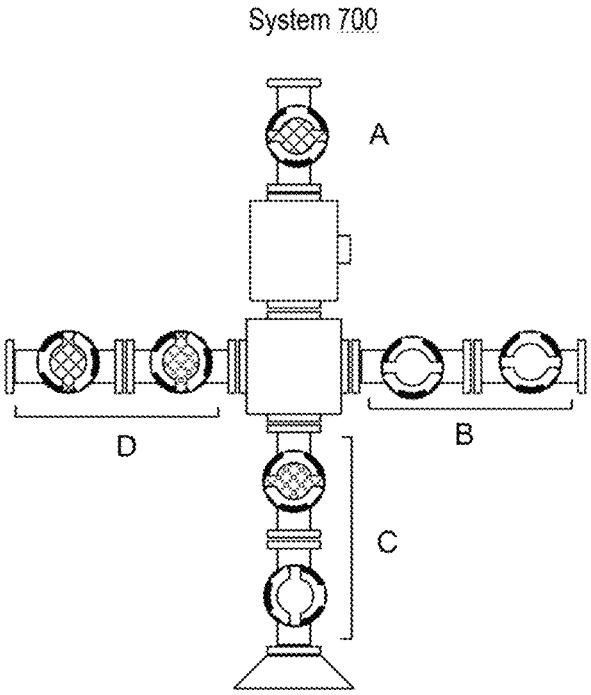
FIG. 12 illustrates an example of a system and an example of code.

FIG. 12 shows an example of the system 700 with its expected valve state in Step X where a coded representation of Step X (e.g., a workflow specification for Step X) is shown. As shown in the example of FIG. 12, the valves can be represented using letters: A, B, C and D. In such an example, each letter may represent one or more valves. For example, B, C and D represent valves to the right of the box (B), to the left of the box (D) and to the bottom of the box (C). As shown, the coded representation can utilize such letters with logical statements. As an example, a GUI may render a representation of the system 700 to a display along with the workflow specification. As indicated, the example coded representation includes state specification for each of A, B, C and D for the workflow specification for Step X.

Figure 13:
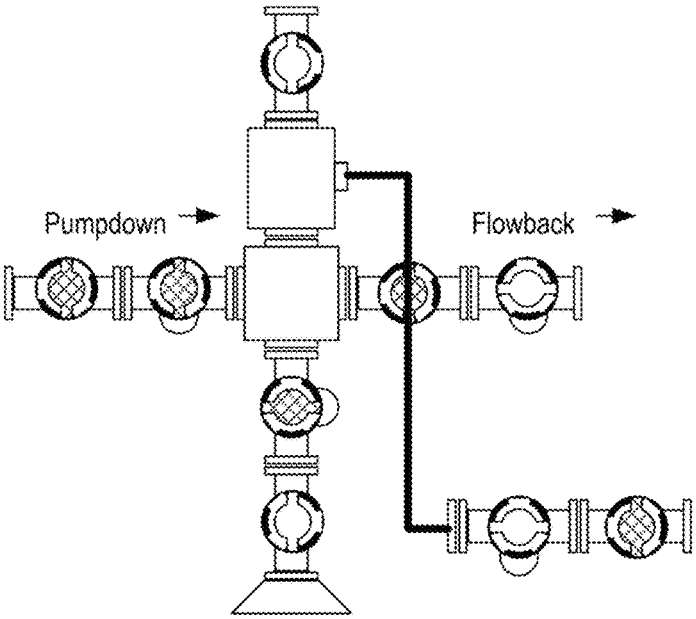
FIG. 13 illustrates an example of a system and an example of a GUI.

FIG. 13 shows an example of a system 1300 and an example of a GUI 1330 where the GUI 1330 includes information generated by a tree state advisor, which, as explained, can be part of a computational framework, optionally implemented via an edge computing device (see, e.g., FIG. 6). As shown, various portions of the system 1300 can be referred to as arms where each arm may be given a name (e.g., master, swab, pumpdown and flowback) while one arm corresponds to the manifold. In the example of FIG. 13, the left arm is labeled pumpdown and includes a direction arrow and the right arm is labeled flowback and includes a direction arrow. As an example, a GUI may present a representation of a frac tree with appropriate labels and, for example, flow direction arrows.

In the example of FIG. 13, the GUI 1330 indicates an expected state (see, e.g., the specification of FIG. 12) and a ready indicator, along with information as to open or close. In the system 1300, each valve can be instrumented to provide real-time state for rendering via the GUI 1330. For example, each valve can include a sensor or a detector that can generate an electrical or other signal that can be received by a computational framework (e.g., advisor) such that the state of each valve is receivable by the computational framework.

As explained, a frac tree can be partitioned into different functional sections (e.g., arms, etc.). In such an approach, for each step in an operation, the expected valve states in each section of a frac tree and/or a manifold can be rendered using the GUI 1330. As an example, an XML format may be utilized as shown in the specification of FIG. 12. Besides all open/all close, when a section includes more than one valve, a specification for a section can be "at least one valve closed" because one closed valve in the section closes the section. With reference to section C in the example system 700 of FIG. 12, one closed valve in section C meets the expected valve states of that section.

As explained, logic can be involved where multiple states may be possible that can meet a requirement. However, to transition from one field operation to another field operation, knowledge of the specific state of one or more valves can be information required to efficiently and safely perform the transition. Again, for a human operator or human operators, logic may not be readily apparent. As to multiple operators, consider one human that habitually adjusts one valve of a section to close that section while another human may habitually adjust a different valve of the section. Where shift changes occur, different habitual practices of different human operators can give rise to delays and/or risks. As explained, a computational framework can help to address such human related issues and demands, thereby improving field operations for fracturing, wireline, monitoring, maintenance, etc.

In the example of FIG. 13, after the expected states are specified, valve actuation can follow the specification. In such an approach, the current valve states in each section can be compared with the expected state in each operational step. For example, valves states in three sections can be cross checked with specifications in an XML file where a discrepancy may be found. In such an approach, an operator can be guided to perform a valve open/close action to meet the expected state specifications. In the example of FIG. 13, the master section and the swab section, as indicated in the GUI 1330, have valves with expected states and no valve actuation is required for these two sections. However, as indicated under the ready column, actions are to be taken for the three other sections, as indicated to be open or close actions.

Figure 14:
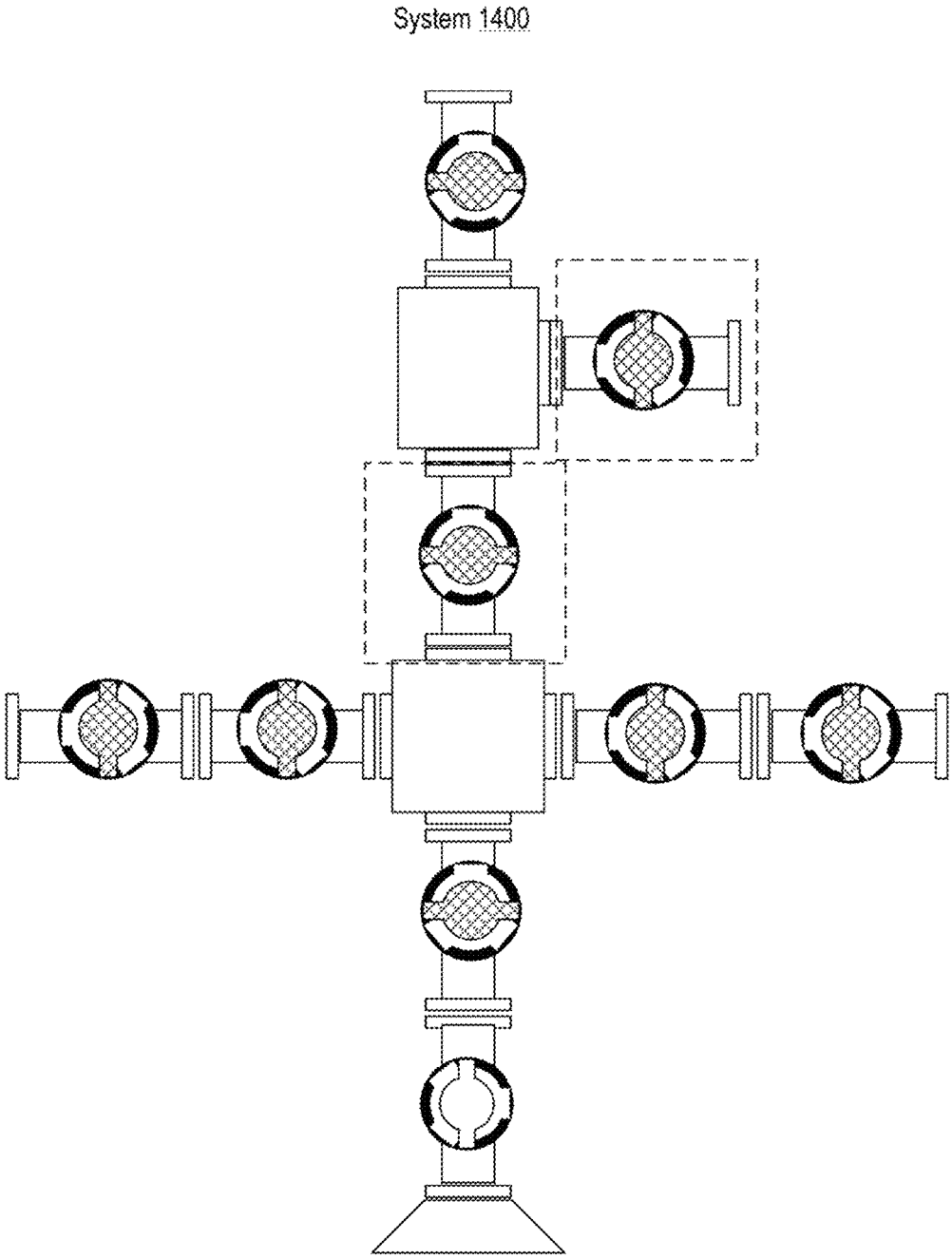
FIG. 14 illustrates an example of a system.

FIG. 14 shows an example variation of a frac tree system 1400 where partitioning may be performed to define sections for which specifications can be generated. For example, consider use of a GUI with interactive controls that can be utilized to select one or more valves for defining as a section. In the example of FIG. 14, dashed line boxes indicate identified sections, which, as mentioned, may include one or more valves.

In operation, a section-based workflow specification and execution can encounter some challenges. For example, consider the variation on frac tree structures. As an example, in some instances, operators may introduce one or more additional functional sections on a frac tree. In the example of FIG. 14, the frac tree system 1400 includes two highlighted valves (see dashed line boxes) that do not appear in the system 700. As explained, sections of a frac tree can be coupled with a framework to support workflow execution. As an example, a framework can provide flexibility to add one or more sections without having to manually code such one or more sections. For example, a GUI feature can allow for selection of one or more valves to define a section whereby a framework encodes the section as including the one or more selected valves (e.g., consider XML encoding, etc.).

As an example, a framework can facilitate specifying a sequence. For example, consider a framework that can specify various sequences of valve open/close actions in a multi-valve section. As explained, when an operation moves from step Y to step X, both valve A and valve B are to be closed. However, with an "all valve open" specification in step Y and "all valve closed" specification in step X, valve B is to be closed before the requirement as to valve A can be enforced. As an example, a framework can include various features for open/close action sequences, which can provide for logical operations with assurances that transitions are made efficiently and safely.

While XML is given as a code format example, which tends to be relatively human friendly for purposes of writing and/or editing, having a human write and/or edit such code can introduce delays and/or error. As an example, a framework can provide for code generation and/or modification in a manner that can reduce human interaction, if utilized, and/or human error. As an example, a framework can provide for easing specification demands for sections of one or more different arrangements, types, etc., of equipment (e.g., valves of frac trees, valves of manifolds, etc.).

As an example, a framework can provide for increased workflow standardization in a manner that can accommodates a variety of systems, including variations of one or more systems. As an example, a framework can provide for designation of a sequence of actuation at an individual valve level and, for example, present a workflow visually (e.g., as a GUI, etc.) such that an operator is able to view and confirm an update or updates.

Figure 15:
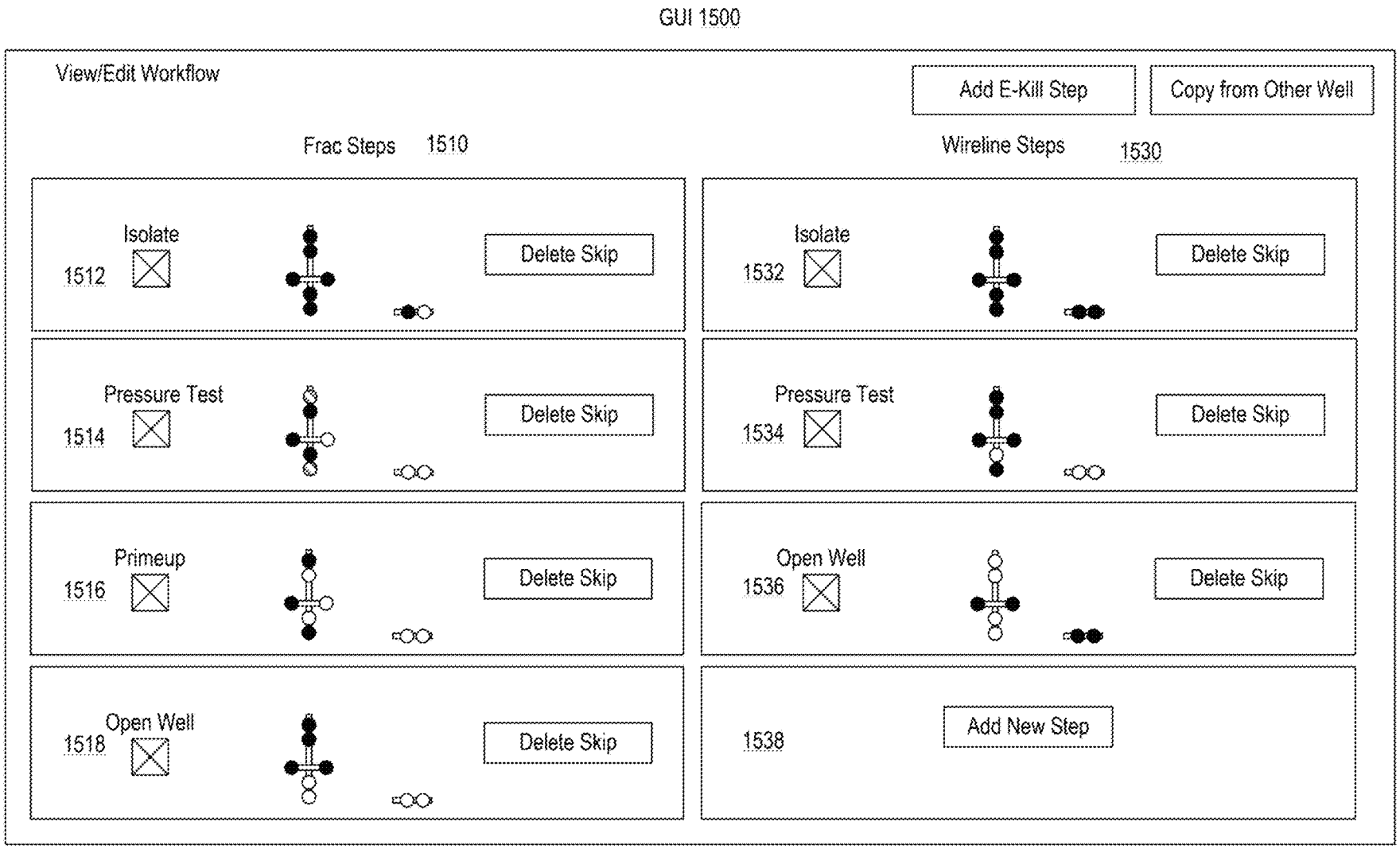
FIG. 15 illustrates an example of a GUI.

FIG. 15 shows an example of a GUI 1500 that includes a set of frac steps 1510 and that includes a set of wireline steps 1530 as examples of steps for two different field operations. As shown, the frac steps 1510 include isolate 1512, pressure test 1514, prime up 1516 and open well 1518 and the wireline steps 1530 include isolate 1532, pressure test 1534 and open well 1536; noting that the GUI 1500 includes an "add a new step" graphical control 1538. In the GUI 1500, a frac tree graphic and a manifold graphic are shown along with valves and valve status as to valve state (e.g., open non-filled circle, closed filled circle, other cross-hatched circle, such as, for example, offline), which can refer to an expected valve state in each step of the workflows 1510 and 1530.

As shown in FIG. 15, the GUI 1500 can be rendered to a display to include various representations of a system, which can include graphical representations of valves of equipment such as a frac tree and/or a manifold. The GUI 1500 can be utilized in an interactive manner by an individual to create, edit, etc., one or more workflows associates with field operations. While the example GUI 1500 shows two states for valves, closed and open, it may provide for indications of other states, degrees of open, offline/online status, transition status, etc. As an example, a state may be locked such that a valve is not to be changed, for example, consider locked open or locked closed. As an example, a GUI may provide for building a representation of valves for equipment.

As explained, a GUI can provide various panels (e.g., windows) with graphical controls for constructing one or more sequences for one or more processes involving valve changes. As shown in FIG. 15, the GUI 1500 includes two processes where one includes four steps and where the other includes three steps. In such an approach, a graphical representation of valves can be rendered along with color or other coding of valve states. In a process building mode, an individual can define a new process or edit an existing process. As explained, a framework can include components that perform checks on a process and/or individual steps of a process, which can include safety checks, checks with respect to standard operating procedures (SOPs), etc. As an example, a process can include instructions that are automatically generated as a process is being built, edited, etc. As explained, such instructions can be executable, for example, to issues signals to one or more actuators, controllers, etc., that can change a state of one or more valves.

As an example, during building of a process, an initial state graphic can be rendered to a display where initial states of valves are set, which may be indicated using color codes or other codes (e.g., black and white, grayscale, hatching, etc.).

As an example, an individual may click a View/Edit Workflow button for a selected well on dashboard to navigate to a View/Edit Workflow page where the individual can start defining a workflow. As shown in the GUI 1500, there can be multiple workflows that can include, for example, a frac workflow, a wireline workflow and/or another workflow. In such an example, the individual can click Add New Step to start adding steps to a workflow. Such an individual may enter a step name and click "Add" to add a new step to the corresponding workflow. A delete button may be provided next to the step that can be used to remove an existing step. An individual may click a step name to navigate to a Define Valve State graphic. In various examples, it is possible to reorder the relative position of each workflow within a mode (frac, wireline, etc.).

As to defining valve state, a GUI can provide for defining valve states for a number of valves where states can include, for example, open, close, and ignore. An individual may click a valve to set the valve to its desired state. After valve states are defined, a Define Order button may then be highlighted (e.g., at a bottom right corner of GUI, etc.), where an individual can click it to navigate to a Define Valve Activation Order graphic.

By defining a valve activation order, as explained, instructions can be generated that can be suitable for purposes of control, monitoring, etc. A defined order can be used in operation to guide a human and/or a machine in actuating valves in order. When defining the order, a framework can include checking the status of one or more valves before opening an upper master valve. As explained, various checking procedures may be utilized for purposes of safety, convenience, etc.

As an example, once valve orders are defined, a Finish Workflow Step graphic can be highlighted, for example, as rendered at a bottom right corner of a GUI, which can be clicked on to finish a workflow step and navigate to the View/Edit Workflow GUI. Where an individual clicks on Define Valves State, a warning message can be rendered (e.g., as a pop-up), to confirm to go back to the Define Valve State step.

As an example, a finished workflow step can result in rendering of an appropriate indicator such as, for example, a green check icon under the step name to indicate the step is completed (see, e.g., the GUI 1500 of FIG. 15). For incomplete workflow steps, another indicator can be rendered such as a red X icon under step name.

As an example, for emergency operations, a Define Valves Activation Order GUI can be rendered where an individual can click highlighted valves to define the sequence of closing during emergency close.

As an example, individual valves can be configured for digital handshakes, which may be performed separately, leveraging granular control over valve operations. During the operation of a well, a digital handshake can be triggered when the configured valve is the current valve to be actuated in sequence.

To start operating a well, a GUI can provide a Take Control button of the well on a dashboard for navigation to an Operation graphic where a default mode of operation can be an idle mode. In this mode, operations on a valve can be prohibited. To operate on valves, a mode switch can be implemented, for example, to advance, frac, wireline, etc. Upon switching, a corresponding structure (e.g., frac tree structure, etc.) can be rendered along with the current valve state and, for example, pressure sensor readings.

As an example, to move between frac and wireline modes safely, a well is to be in an isolate state. In such an example, an interlock can exist to enforce the isolate state. If a step in a workflow is marked as an isolate step using a graphical control toggle, an individual can apply an isolate interlock to a mode.

As an example, in a mode, based on the activation order defined in workflow step, a flashing circle can be rendered to appear on a valve/set of valves to indicate that it is or they are to be actuated next. For remote control of valve actuation, connected skids can be in remote control mode. As an example, in wireline mode, pre-defined workflow steps can be rendered as a list under Wireline Activity Steps. As an example, an individual can select a step and after selecting the step, a GUI can then highlight valves that demand actuation. Based on the activation order defined in the workflow step, a flashing indicator (e.g., a circle, etc.) can be rendered on the valve/valves to indicate that next actuation. In wireline mode, valve actuations follow the order that was defined in workflow step. To remotely control valve actuations, connected skids can be in remote control mode.

With digital handshakes, a framework can demand permission to actuate valves. In such an approach, permissions records (e.g., a permissions log) can be generated such that timing and granting of permission can be recorded and reviewed as appropriate.

Figure 16:
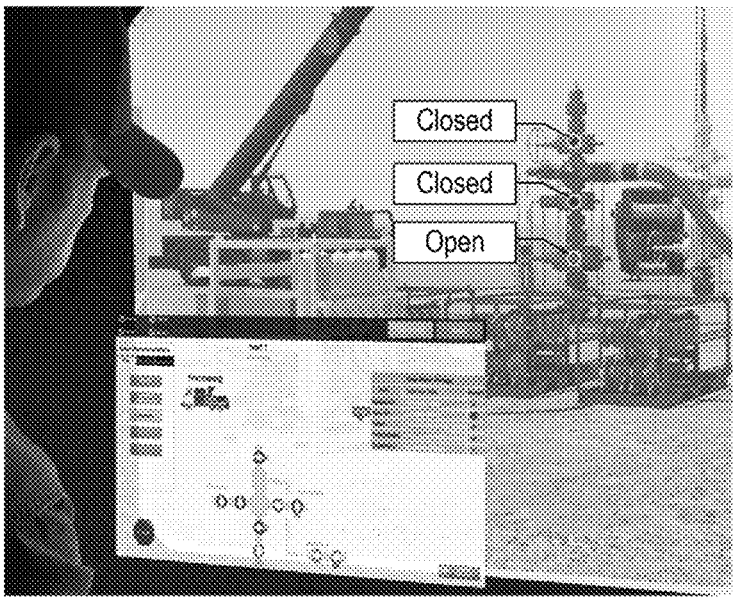
FIG. 16 illustrates an example of a system and an example of a GUI.
Figure 16:
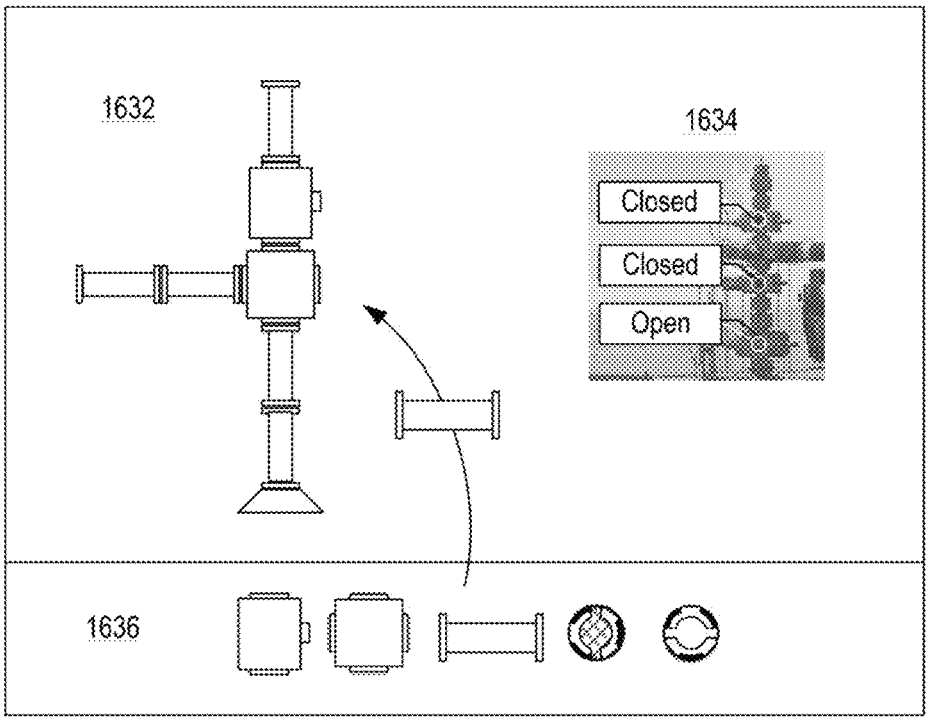

FIG. 16 shows an example of a system 1600 where an individual is in a cabin and where a display has a rendered GUI for aiding in valve management and control. As shown, the cabin can include a window that may allow the individual to see equipment being controlled. In such an example, an augmentation feature may provide for presenting indicators to the window that may indicate status of one or more aspects of the equipment (e.g., open, closed, etc.).

FIG. 16 also shows an example of a GUI 1630 that includes a builder feature 1632, an image feature 1634 (e.g., for rendering a live and/or captured image of field equipment) and a menu feature 1636 where an individual may look at an image of equipment and build a digital representation of the equipment using various items selected from a menu (e.g., drag and drop, etc.). In such an approach, the individual may build the digital representation with valves, optionally in particular states. As an example, the system 1600 may utilize image recognition to process a digital image of equipment (e.g., digital photograph) to automatically build at least a portion of equipment and/or to automatically populate a menu or menu region with appropriate items for use in building a digital representation of the equipment. As an example, the system 1600 may receive a diagram such as a piping and instrumentation diagram (PID) and build a digital representation of equipment and/or populate a menu. As an example, the system 1600 may be suitable for building digital representations of frac trees, manifolds, trunk lines, etc., where such equipment includes one or more valves and collectively two or more valves. As an example, the system 1600 of FIG. 16 can be enabled at least in part using a local edge framework such as, for example, the EF 610 of FIG. 6. For example, in the system 1600, the display may be part of a mobile device or other computing device that can establish communication with a local edge framework where the local edge framework can be operatively coupled to equipment (e.g., actuators, sensors, etc.).

As an example, the display shown in the system 1600 may render a GUI such as the GUI 1500 of FIG. 15. In such an approach, an individual can generate and/or edit one or more sequences for valve changes, which may be stored in an appropriate manner to memory and/or communicated, for example, to a local edge framework. As an example, a JavaScript Object Notation (JSON) approach may be utilized. JSON is an open standard file format and data interchange format that can use human-readable text to store and transmit data objects consisting of attribute—value pairs and arrays. JSON is suitable for use as a common data format in electronic data interchange, including that of web applications with servers. As explained with respect to FIG. 15, an HMI visual presentation of expected valve states in each step of a workflow can be generated where an individual can see each valve's expected state and its position with respect to equipment (e.g., a frac tree, a manifold, a trunk line, etc.).

Figure 17:
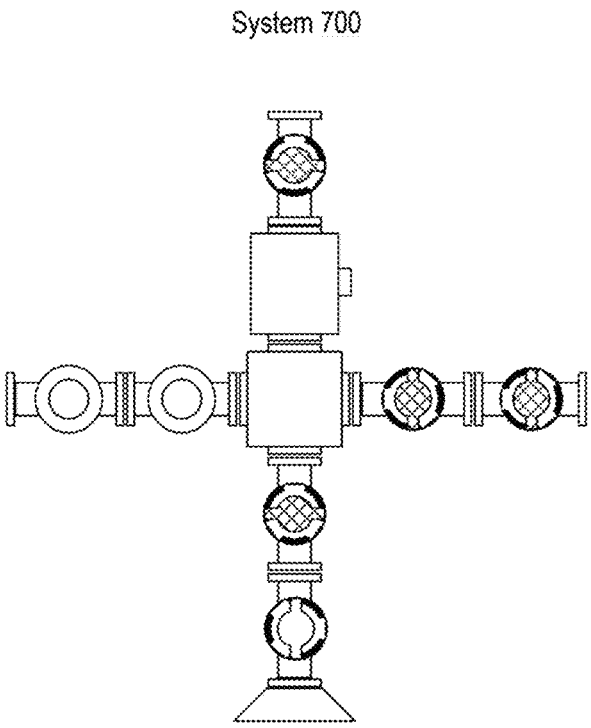
FIG. 17 illustrates examples of a system and an example of a GUI.
Figure 17:
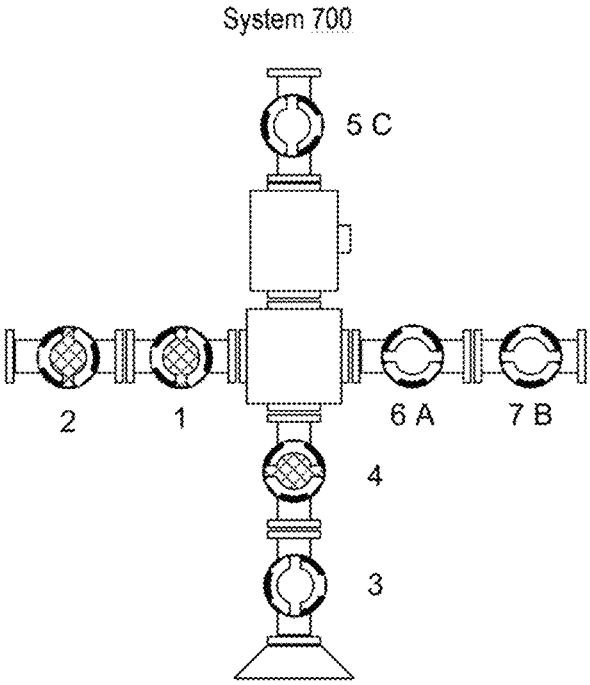
Figure 17:
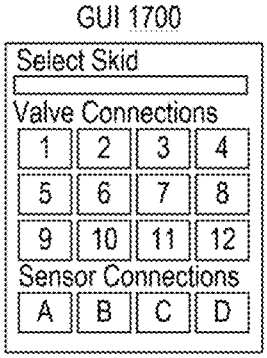

FIG. 17 shows the example system 700 as may be rendered as a GUI to a display, for example, during a valve state where valve state and order assignment occur for a step or steps as part of a valve state specification in a workflow. FIG. 17 also shows an example of a GUI 1700 that can be utilized in assigning numbers and identification of one or more sensors where, for example, the one or more sensors can correspond to individual valves according to a letter. In such an approach, sensed information as to a state of a valve can be appropriately received by a framework to assure appropriate logic is implemented in a safe and effective manner for valve states and transitions for one or more types of field operations. As shown, the GUI 1700 can include a select graphical control for selection of particular equipment, which may be skid-based and include or be operatively coupled to an HPU for transitioning valve states. As to use of numbers, they can provide for direct ordering, sequencing, etc. As an example, identifiers may be utilized that can ultimately be ordered numerically. Hence, while numbers are mentioned, in various examples, identifiers can be utilized that ultimate correspond to numbers such that assigning identifiers effectively assigns numbers. As an example, after assignments are completed, a validation check may occur, for example, to assure that all relevant valves are assigned and that sensors are enabled and operable to detect valve states.

As mentioned, such an approach may generate JSON code. As an example, in each step, a specification can starts with a frac tree with an empty state specification for valves on the frac tree. For example, consider starting once an individual has built a digital representation via GUI interactions and/or via automatic or semi-automatic system processing (e.g., PID based, image based, etc.). As explained, an open state or close state can be assigned to each valve where the term "open" means to open or opened and where the term "close" means to close or closed. In FIG. 17, empty, open and close states are shown on valves during assignment. The step X or step Y specification as in FIG. 10 can be applied to 7 valves quickly with expected states. For example, see valves numbered 1 to 7, where valves 5, 6 and 7 may be assigned letters C, A and B, respectively, and where graphics can indicate open or closed.

As an example, a desirable sequence of valve movement can be provided by the order of state checking. For example, a unique number can be assigned to each valve once the valves have their expected states assigned as shown in FIG.

17 (bottom). In such an example, for the step Y, a framework can check the valve with number 1 first to make sure its state is closed. Once this valve's state is closed, the checking can move to the valve with number 2. As an example, a combination of letters and numbers may be utilized for generating processes (e.g., workflows) and for executing processes. While letters and numbers are mentioned, one or more other coding systems may be utilized.

Figure 18:
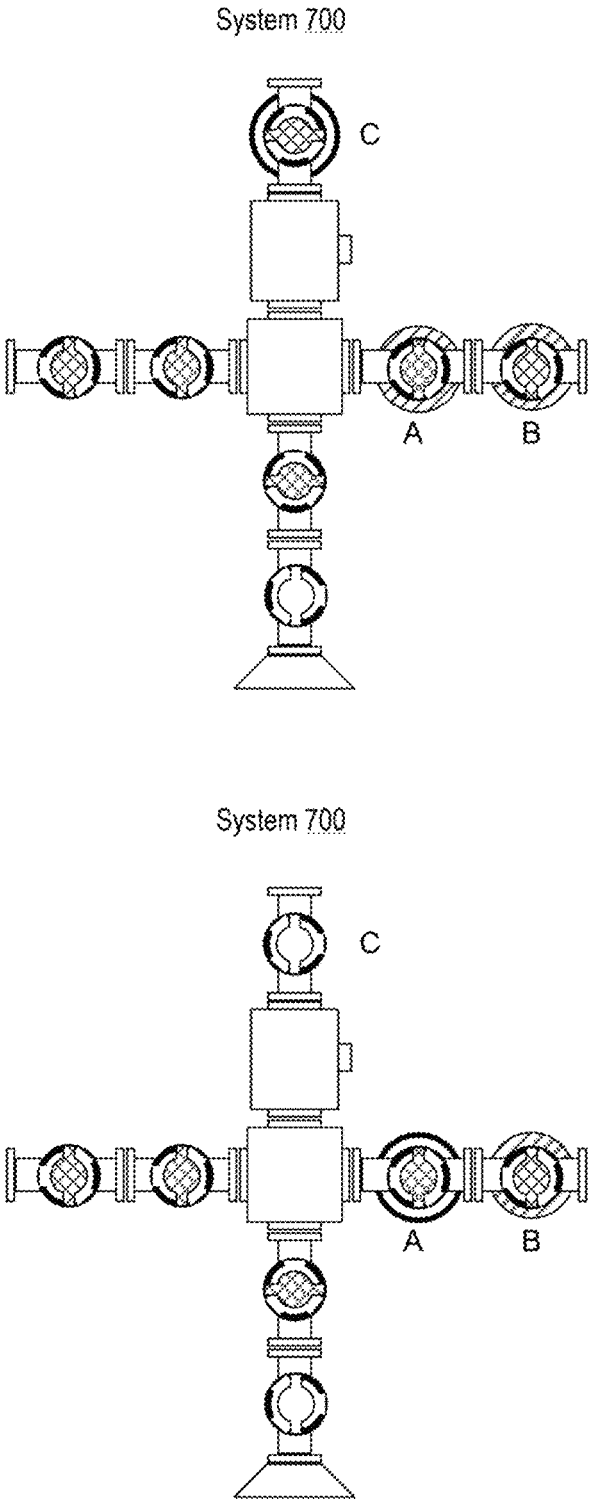
FIG. 18 illustrates examples of a system.

FIG. 18 shows examples of the system 700 where a sequence can involve moving valve C first (see thick ring that highlights valve C) and moving valve A after valve C as part of a workflow in execution from step X to step Y (see also FIG. 10). In the example of FIG. 18, valves to be involved in a step can be highlighted appropriately to provide a visual cue to an operator. As mentioned, a valve to be adjusted can be highlighted with a thick ring (e.g., or color, flashing, etc.) while other valves to be involved in a workflow can be highlighted using a different indicator (see cross-hatched rings).

To guide an individual in movement or monitoring automated movement of valves, a GUI may render representations as in FIG. 18 such that the individual can perform checking of a sequence as to changes in valve states accordingly. As an example, when an operation shifts from step X to step Y, valves A, B and C can be opened per a specification. In such an approach, the assigned order number on them determines the opening order to be C A B. Therefore, while all three valves are highlighted to indicate their states are not as expected (see thick ring and cross-hatched rings), valve C is emphasized since its state must be open first (see thick ring). After valve C is open, valve A is the next one which does not have its expected state, therefore, it must be opened before valve B. As explained, a GUI can provide graphical, visual cues such that an operator can be assured as to what action is to be taken for what valve or valves. Such an approach can help to assure compliance with workflow specifications, reduce risk, improve efficiency and ultimately improve field operations.

Figure 19:
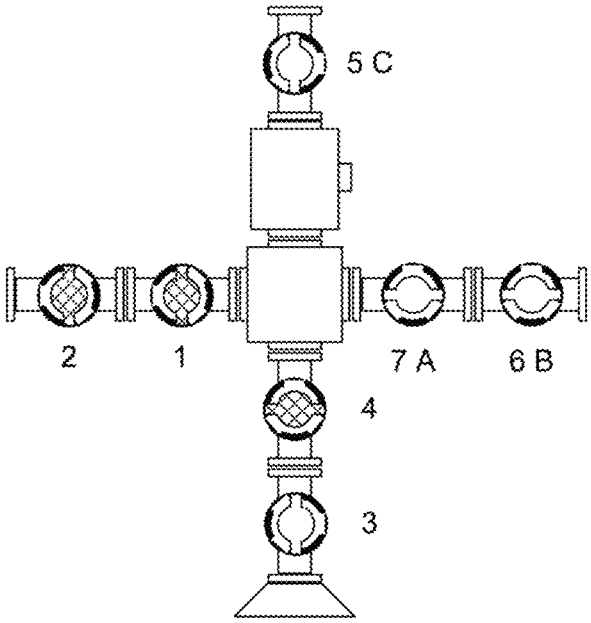
FIG. 19 illustrates examples of a system.
Figure 19:
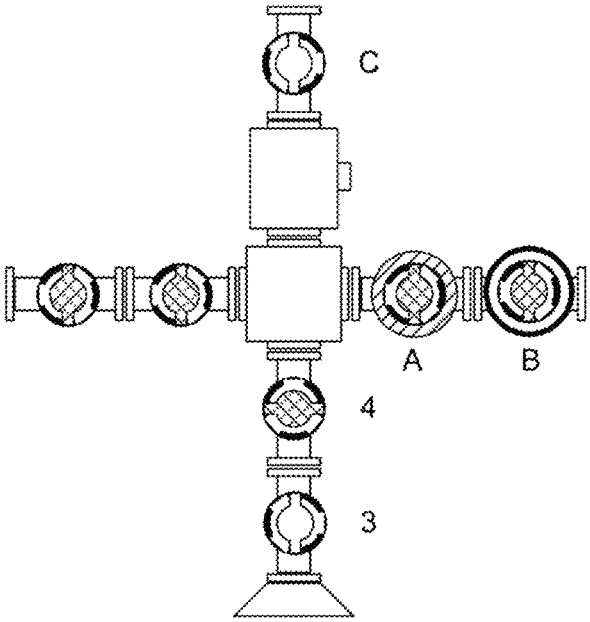

FIG. 19 shows example representations of the system 700 where a different order number assignment for a different valve actuation sequence is illustrated per an updated workflow specification and execution. For example, if the order number assignment between valve A and B is swapped (e.g., from 6 and 7 to 7 and 6, respectively), then valve B is to be opened after valve C becomes open. As shown, the valve B is highlighted by a thick ring while the valve A is highlighted with a cross-hatched ring, which indicates that valve B is to be opened before valve A is opened. Further, as explained, each valve has its own status indicated, which, in the example of FIG. 19, status is shown as either open or closed.

As an example, a framework can help in control of movements of a sequence to a valve level instead of at a section level. As explained, logic can be specified and captured via a computational framework such that a human can oversee field operations without having to fully set aside time for figuring out logic and following the logic, particularly where different humans may have different habits and/or operate differently in performing tasks, which may have more than one manner to accomplish (e.g., consider two valves on a section where either valve may be suitably closed to close flow in that section).

As explained, a GUI can provide a presentation of expected valve states in each step of a workflow (see, e.g., the GUI 1500 of FIG. 15) where an operator can see each valve's expected state and its position on the tree (e.g., or manifold, trunk line, etc.). In each step, a specification starts with a frac tree with an empty state specification for valves on the frac tree. Open or close state can be assigned to each valve. The aforementioned step X or step Y specification can be applied to the 7 valves of the frac tree of the system 700, quickly with expected states. As explained, a framework can provide for a desirable sequence of valve movement by the order of state checking. As shown in FIG. 17, a unique number is assigned to each valve once all valves have expected states assigned. In FIG. 17, a transition from the upper graphic to the lower graphic occurs once the two valves on the left arm are assigned expected states where unique numbers are assigned, for example, from 1 to 7 for the 7 valves. For the example step Y, a framework can check the valve with number 1 first to make sure its state is closed (as it is in FIG. 17, lower graphic). Once this valve's state is closed, the checking algorithm can move to valve with number 2, which is on the same arm as the valve with number 1.

To guide an individual moving along a sequence of checking and change valve state accordingly, graphics such as those of FIG. 8 can be rendered to a display. When an operation shifts from step X to step Y, valve A, B, C are to be opened. Note that in the upper graphic of FIG. 18, these three valves are highlighted where, for example, transitioning the state of the valve C from closed to open causes the highlighting to disappear as indicated in the lower graphic of FIG. 18. As explained, the assigned order number on them determined the opening order to be C A B. Therefore, while all three valves are highlighted to indicate their states are not as expected in the upper graphic of FIG. 18, valve C is emphasized since its state must be open first (see red circle versus orange circle). After valve C is open, valve A is the next one that does not have its expected state, therefore, valve A is to be opened before valve B. As shown in FIG. 18, lower graphic, highlighting has disappeared from valve C and valve A is highlighted with a thick ring while valve B is highlighted with a cross-hatched ring.

As explained, graphics can be utilized to highlight valves that are not in their expected states and to indicate what valve or valves are to be changed next in a sequence of changes. As explained, a framework can provide for building sequences as workflows or processes and then for implementation of such workflows or processes, which can occur automatically, semi-automatically and/or manually via issuance of control signals and/or manually turning valves to change state. As explained, various levels of instrumentation and control may be provided. As an example, a system may be a hybrid system with actuated valves and manual turn valves. Whether hybrid or not, a framework can provide for guiding valve changes such that workflows are performed appropriately.

As explained with respect to FIG. 19, if there is a swap in the order of number assignment between valve A and B, then valve B is to be opened after valve C becomes open. Such an implementation can help to control the movement sequence to the valve level instead of by section. Specifically, in FIG. 19, the upper graphic can be compared to the lower graphic of FIG. 17 where the right arm valves are swapped from 6 and 7 to 7 and 6. While A, B and C are still utilized, the checking algorithm now calls for valve B to be highlighted for change of state prior to valve A.

As explained with respect to FIG. 10, when an operation shifts from step X to step Y, valve A, B and C are to be opened and when the operation shifts from step Y and step X, those three valves are to be closed. When such valve state changes are performed manually, human error is possible as the right valve or right handle on the H P U is to be selected before the state of the valve can be changed. Furthermore, there is no direct feedback about the valve status so that human error might not be detected in time. Finally, there could be a requirement on the order of valve state change. As explained, from step X to step Y, the valves can be specified to be opened in the sequence of C A B and the order could be C B A.

As an example, a framework can consider enforcement of a valve state change sequence to achieve expected state on each valve in each step of operation as a control workflow. As explained, a workflow can be defined by a specification (e.g., a workflow specification) that can help to promote or achieve operation standardization.

As explained, a framework can provide workflow standardization in a manner that can accommodate variation of frac tree structures and designate sequence of actuation to an individual valve level along with presenting a workflow visually such that an operator is able to view and confirm the updates.

As explained, a framework can provide logic for valve state sequences as associated with workflows. A graphic can be generated that shows states as assigned or to be assigned where once assigned numbers can be utilized for the valves where letters can be utilized for valves that are to have their states changed.

As explained, various checks and balances can be implemented by a framework, which may be specific to particular entities, types of wells, types of equipment, etc. For example, various example systems show two master valves where in some instances both are to be closed according to a safety constraint while in other instances it is sufficient for one to be closed according to a safety constraint. As explained, a frac tree may include a cross shape; however, a frac tree may have a different structure.

As an example, a framework can provide for implementing a validation phase. For example, a framework can receive information from various sensors, actuators, etc., such that a system is validated prior to utilization of the framework in managing, monitoring, controlling, etc., valve changes. As an example, where a building process utilizes a pre-existing file as a starting point, various checks may be made to assure that pre-existing information does not inappropriately carry over in a detrimental manner.

As an example, a framework can handle operations for more than one well, which may utilize a common source of water, proppant, etc. For example, consider a pad that includes four wells. As an example, a framework can render a GUI that includes equipment with valve states and operations for a number of wells, which can be for a common pad. In such an example, an operator may click or hover over a GUI to render additional information.

Figure 20:
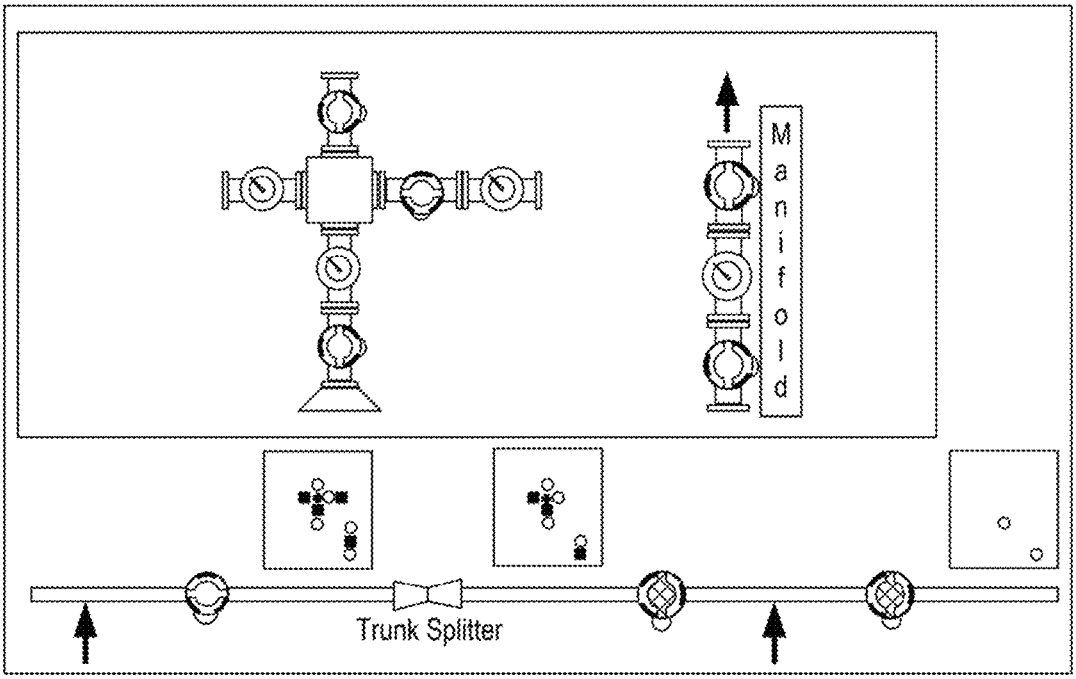
FIG. 20 illustrates examples of GUIs.
Figure 20:
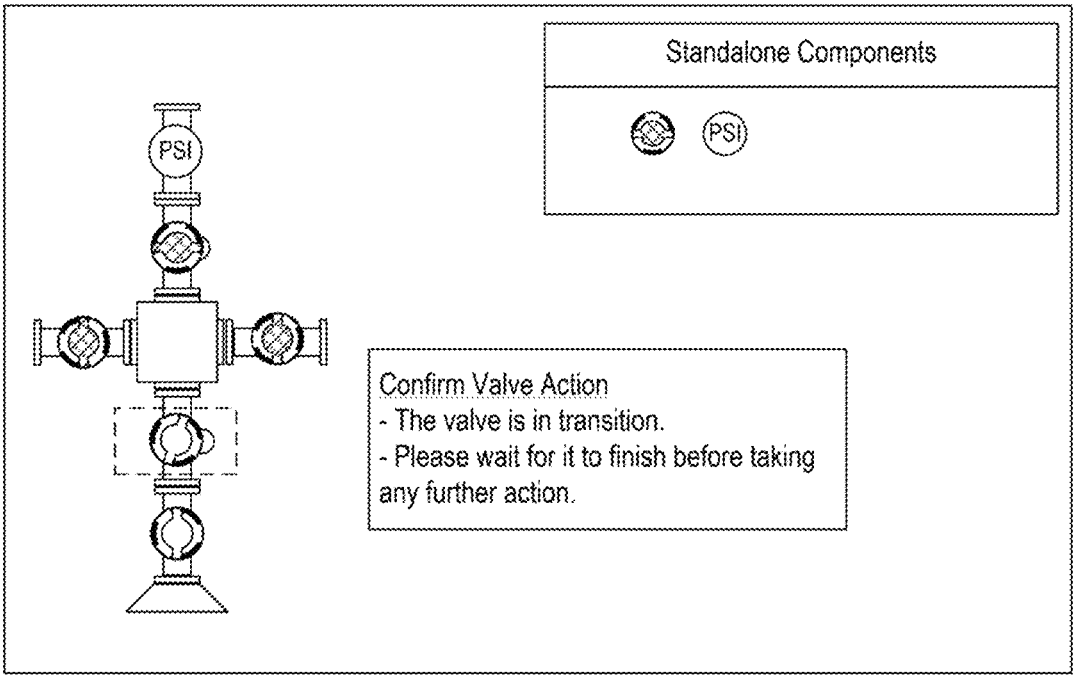

FIG. 20 shows example GUIs 2010 and 2030 where the GUI 2010 shows examples of equipment with various valves and where the GUI 2030 shows a valve action that can be a valve transition, which may be a manual or automatic transition. As explained, a framework can provide for management, monitoring, control, etc., of equipment with valves where particular sequences of changes in valve states are to occur for one or more purposes. In the example GUI 2010, a trunk splitter is shown, which can provide for splitting of an equipment trunk into sections, which may each serve different equipment.

Figure 21:
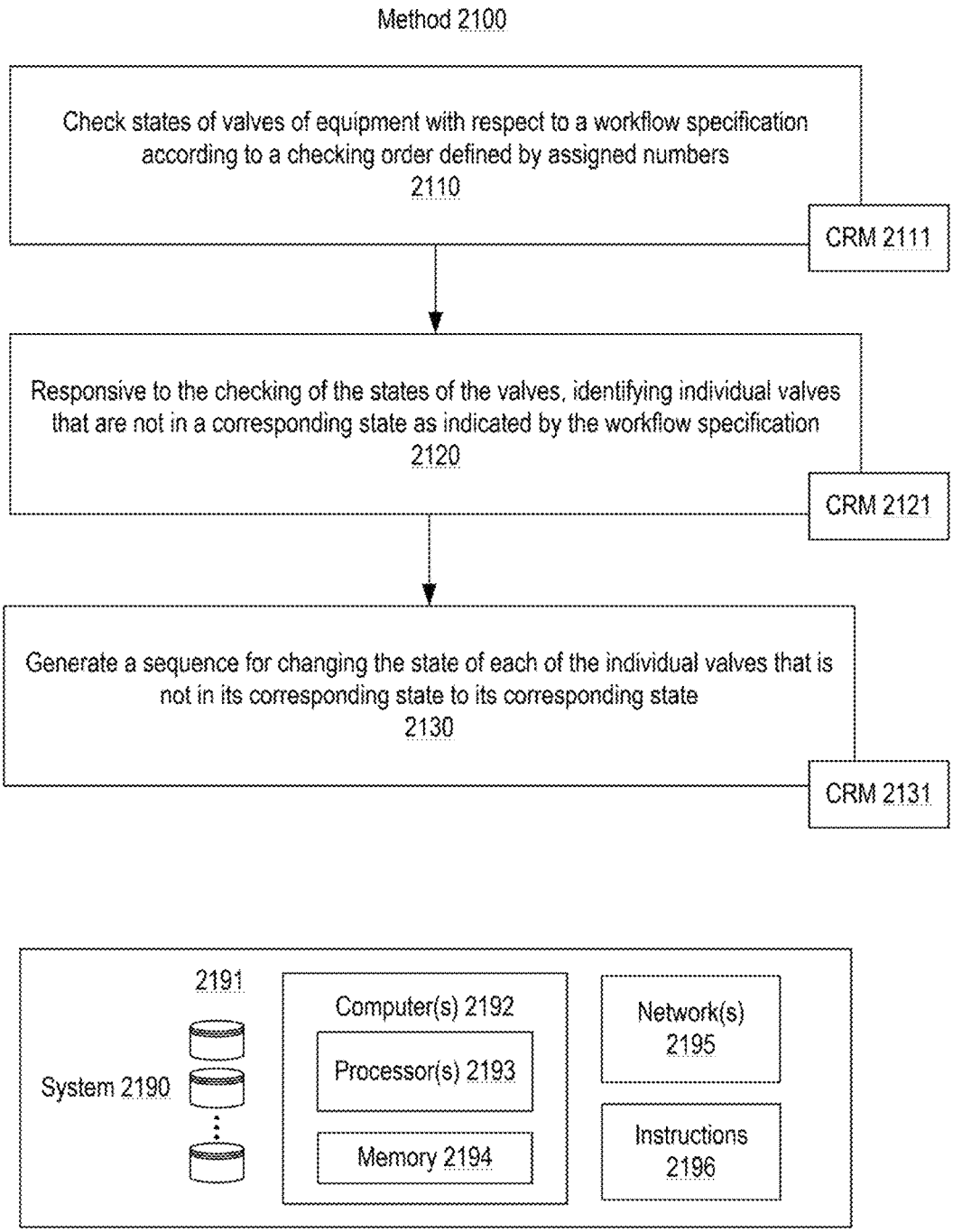
FIG. 21 illustrates an example of a method and an example of a system.

FIG. 21 shows an example of a method 2100 that includes a check block 2110 for checking states of valves of equipment with respect to a workflow specification according to a checking order defined by assigned numbers; an identification block 2120 for, responsive to the checking of the states of the valves, identifying individual valves that are not in a corresponding state as indicated by the workflow specification; and a generation block 2130 for generating a sequence for changing the state of each of the individual valves that is not in its corresponding state to its corresponding state.

In the example of FIG. 21, a system 2190 includes one or more information storage devices 2191, one or more computers 2192, one or more networks 2195 and instructions 2196. As to the one or more computers 2192, each computer may include one or more processors (e.g., or processing cores) 2193 and memory 2194 for storing the instructions 2196, for example, executable by at least one of the one or more processors. As an example, a computer may include one or more network interfaces (e.g., wired or wireless), one or more graphics cards, a display interface (e.g., wired or wireless), etc.

The method 2100 is shown along with various computer-readable media blocks 2111, 2121 and 2131 (e.g., CRM blocks). Such blocks may be utilized to perform one or more actions of the method 2100. For example, consider the system 2190 of FIG. 21 and the instructions 2196, which may include instructions of one or more of the CRM blocks 2111, 2121 and 2131.

As an example, a method can include checking states of valves of equipment with respect to a workflow specification according to a checking order defined by assigned numbers; responsive to the checking of the states of the valves, identifying individual valves that are not in a corresponding state as indicated by the workflow specification; and generating a sequence for changing the state of each of the individual valves that is not in its corresponding state to its corresponding state. In such an example, the workflow specification can correspond to a fracturing operation or a wireline operation. In such an example, the sequence can be determined by an order of the assigned numbers.

As an example, a method can include generating a workflow specification. For example, a computational framework can provide for workflow generation using various features to add a workflow and to add steps to the workflow.

As an example, a method can include rendering a graphical user interface to a display that includes at least one instance of a graphical representation of equipment. In such an example, responsive to identifying individual valves, the method can include highlighting the individual valves where, for example, the method can include highlighting one of the individual valves differently to indicate that it is next in the sequence for changing the state.

As an example, equipment can include a frac tree where, for example, the frac tree includes a vertical structure with a bore for receipt of wireline equipment.

As an example, a method can include instructing an actuator to change the state of at least one individual valve according to a sequence where, for example, the actuator may be a hydraulic actuator, an electrical actuator or another type of actuator.

As an example, valves can include machine actuatable valves and/or manual valves.

As an example, workflow specification can be or include an emergency specification.

As an example, a computational framework can be utilized to generate a sequence and/or to generate a workflow specification.

As an example, a system can include a processor; a memory accessible to the processor; processor-executable instructions stored in the memory and executable to instruct the system to: check states of valves of equipment with respect to a workflow specification according to a checking order defined by assigned numbers; responsive to the check of the states of the valves, identify individual valves that are not in a corresponding state as indicated by the workflow specification; and issue a sequence of instructions for changing the state of each of the individual valves that is not in its corresponding state to its corresponding state. In such an example, the sequence can be determined by an order of the assigned numbers.

As an example, a system can include an interface where a sequence of instructions can be issued via the interface. In such an example, a display interface can be utilized where the instructions include instructions to render a graphical user interface to a display. As an example, an interface can be a control interface where instructions to control at least one actuator can be issued.

As an example, one or more non-transitory computer-readable storage media can include computer-executable instructions executable to instruct a computing system to: check states of valves of equipment with respect to a workflow specification according to a checking order defined by assigned numbers; responsive to the check of the states of the valves, identify individual valves that are not in a corresponding state as indicated by the workflow specification; and issue a sequence of instructions for changing the state of each of the individual valves that is not in its corresponding state to its corresponding state.

As an example, a computer program product can include instructions to instruct a computing system to perform one or more methods as described herein.

As an example, a system may include instructions, which may be provided to analyze data, control a process, perform a task, perform a workstep, perform a workflow, etc.

Figure 22:
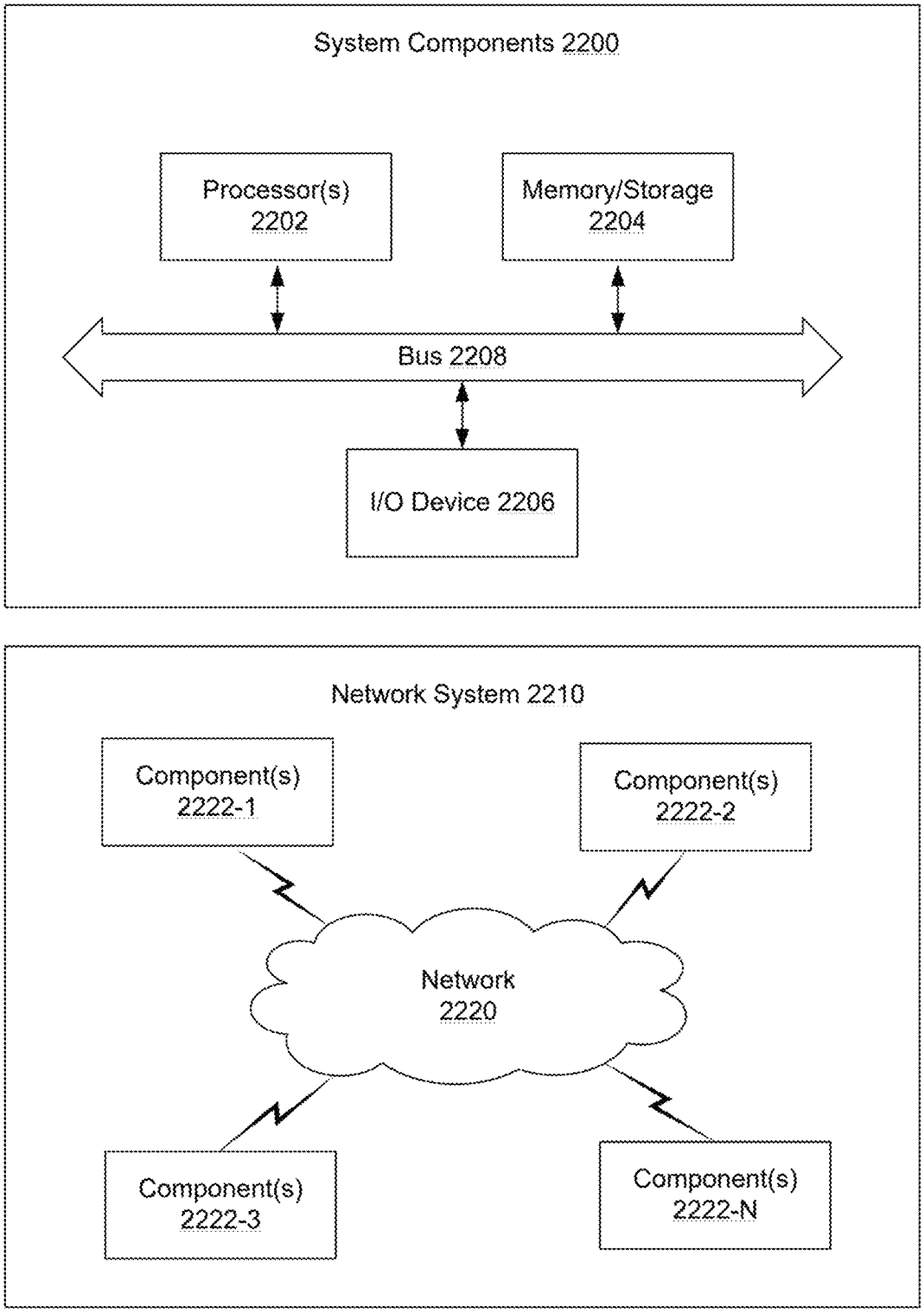
FIG. 22 illustrates example components of a system and a networked system.

FIG. 22 shows components of an example of a computing system 2200 and an example of a networked system 2210 and a network 2220. The system 2200 includes one or more processors 2202, memory and/or storage components 2204, one or more input and/or output devices 2206 and a bus 2208. In an example embodiment, instructions may be stored in one or more computer-readable media (e.g., memory/storage components 2204). Such instructions may be read by one or more processors (e.g., the processor(s) 2202) via a communication bus (e.g., the bus 2208), which may be wired or wireless. The one or more processors may execute such instructions to implement (wholly or in part) one or more attributes (e.g., as part of a method). A user may view output from and interact with a process via an I/O device (e.g., the device 2206). In an example embodiment, a computer-readable medium may be a storage component such as a physical memory storage device, for example, a chip, a chip on a package, a memory card, etc. (e.g., a computer-readable storage medium).

In an example embodiment, components may be distributed, such as in the network system 2210, which includes the network 2220. The network system 2210 includes components 2222-1, 2222-2, 2222-3, . . . 2222-N. For example, the components 2222-1 may include the processor(s) 2202 while the component(s) 2222-3 may include memory accessible by the processor(s) 2202. Further, the component(s) 2222-2 may include an I/O device for display and optionally interaction with a method. The network may be or include the Internet, an intranet, a cellular network, a satellite network, etc.

As an example, a device may be a mobile device that includes one or more network interfaces for communication of information. For example, a mobile device may include a wireless network interface (e.g., operable via IEEE 802.11, ETSI GSM, BLUETOOTH, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

As an example, a system may be a distributed environment, for example, a so-called "cloud" environment where various devices, components, etc. interact for purposes of data storage, communications, computing, etc. As an example, a device or a system may include one or more components for communication of information via one or more of the Internet (e.g., where communication occurs via one or more Internet protocols), a cellular network, a satellite network, etc. As an example, a method may be implemented in a distributed environment (e.g., wholly or in part as a cloud-based service).

As an example, information may be input from a display (e.g., consider a touchscreen), output to a display or both. As an example, information may be output to a projector, a laser device, a printer, etc. such that the information may be viewed. As an example, information may be output stereographically or holographically. As to a printer, consider a 2D or a 3D printer. As an example, a 3D printer may include one or more substances that can be output to construct a 3D object. For example, data may be provided to a 3D printer to construct a 3D representation of a subterranean formation. As an example, layers may be constructed in 3D (e.g., horizons, etc.), geobodies constructed in 3D, etc. As an example, holes, fractures, etc., may be constructed in 3D (e.g., as positive structures, as negative structures, etc.).

Although only a few example embodiments have been described in detail above, those skilled in the art will readily appreciate that many modifications are possible in the example embodiments. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A method comprising:

executing a computational framework for valves of portions of equipment, wherein each of the valves is assigned a number, and wherein each of the portions is definable by a respective state selected from an at least one valve closed state, an all valves closed state, and an all valves open state;

checking valve states of the valves with respect to a workflow specification according to a checking order defined by the assigned numbers;

responsive to the checking of the valve states of the valves, identifying individual valves that are not in a corresponding valve state as indicated by the workflow specification; and generating a sequence for changing the valve state of each of a number of the individual valves to its corresponding valve state for satisfying defined states of the portions.

2. The method of claim 1, wherein the sequence is determined by an order of the assigned numbers.

3. The method of claim 1, wherein the workflow specification corresponds to a fracturing operation, a wireline operation, a maintenance operation, or a monitoring operation.

4. The method of claim 1, comprising generating the workflow specification.

5. The method of claim 1, comprising rendering a graphical user interface to a display that comprises at least one instance of a graphical representation of the equipment.

6. The method of claim 5, wherein, responsive to the identifying individual valves, highlighting the individual valves.

7. The method of claim 6, wherein the highlighting comprises highlighting one of the individual valves differently to indicate that it is next in the sequence for changing the valve state.

8. The method of claim 1, wherein the equipment comprises a frac tree, wherein the frac tree comprises a vertical structure with a bore for receipt of wireline equipment.

9. The method of claim 1, comprising instructing an actuator to change the valve state of at least one of the individual valves according to the sequence.

10. The method of claim 9, wherein the actuator comprises a hydraulic actuator.

11. The method of claim 1, wherein the valves comprise machine actuatable valves.

12. The method of claim 1, wherein the valves comprise manual valves.

13. The method of claim 1, wherein the workflow specification comprises an emergency specification.

14. The method of claim 1, wherein one of the portions, defined by the at least one valve closed state, comprises multiple valves, and wherein one of the multiple valves being closed satisfies the defined state by closing flow in the one of the portions.

15. A system comprising:

a processor;

a memory accessible to the processor;

processor-executable instructions stored in the memory and executable to instruct the system to:

assign numbers to valves of portions of equipment;

define for each of the portions a respective state selected from an at least one valve closed state, an all valves closed state, and an all valves open state;

check valve states of the valves with respect to a workflow specification according to a checking order defined by the assigned numbers;

responsive to the check of the valve states of the valves, identify individual valves that are not in a corresponding valve state as indicated by the workflow specification; and issue a sequence of instructions for changing valve state of each of a number of the individual valves to its corresponding valve state for satisfying the defined states of the portions.

16. The system of claim 15, wherein the sequence is determined by an order of the assigned numbers.

17. The system of claim 15, comprising an interface, wherein the sequence of instructions is issued via the interface.

18. The system of claim 17, wherein the interface comprises a display interface and wherein the instructions comprise instructions to render a graphical user interface to a display.

19. The system of claim 17, wherein the interface comprises a control interface and wherein the instructions comprise instructions to control at least one actuator.

20. One or more non-transitory computer-readable storage media comprising computer-executable instructions executable to instruct a computing system to:

assign numbers to valves of portions of equipment;

define for each of the portions a respective state selected from an at least one valve closed state, an all valves closed state, and an all valves open state;

check valve states of the valves with respect to a workflow specification according to a checking order defined by the assigned numbers;

responsive to the check of the valve states of the valves, identify individual valves that are not in a corresponding valve state as indicated by the workflow specification; and issue a sequence of instructions for changing valve state of each of a number of the individual valves to its corresponding valve state for satisfying the defined states of the portions.

* * * * *